US008701889B2

(12) United States Patent
Loftin

(10) Patent No.: US 8,701,889 B2
(45) Date of Patent: Apr. 22, 2014

(54) CONTAINER FOR HOUSING A TRAY OR BLISTER PACK

(75) Inventor: Caleb S. Loftin, Richmond, VA (US)

(73) Assignee: MeadWestvaco Corporation, Richmond, VA (US)

( * ) Notice: Subject to any disclaimer, the term of this patent is extended or adjusted under 35 U.S.C. 154(b) by 264 days.

(21) Appl. No.: 13/056,323

(22) PCT Filed: Jul. 15, 2009

(86) PCT No.: PCT/US2009/050651
§ 371 (c)(1), (2), (4) Date: Jan. 28, 2011

(87) PCT Pub. No.: WO2010/014396
PCT Pub. Date: Feb. 4, 2010

(65) Prior Publication Data

US 2011/0127320 A1 Jun. 2, 2011

(30) Foreign Application Priority Data

Jul. 31, 2008 (GB) ..... 0813937.0

(51) Int. Cl.
*B65D 83/04* (2006.01)
*B65D 25/54* (2006.01)

(52) U.S. Cl.
USPC ..... 206/528; 206/468

(58) Field of Classification Search
USPC ..... 206/531, 528, 538, 468, 461, 232, 815, 206/540; 229/126, 162.2
See application file for complete search history.

(56) References Cited

U.S. PATENT DOCUMENTS

| | | | | |
|---|---|---|---|---|
| 6,047,829 | A * | 4/2000 | Johnstone et al. | 206/531 |
| 6,230,893 | B1 * | 5/2001 | Karow | 206/531 |
| 6,641,031 | B2 * | 11/2003 | Evans et al. | 229/102 |
| 6,752,272 | B2 * | 6/2004 | Jones et al. | 206/534 |
| 6,874,636 | B2 * | 4/2005 | Paliotta et al. | 206/531 |
| 7,325,689 | B2 * | 2/2008 | Buss | 206/532 |
| 7,563,468 | B2 * | 7/2009 | Bougoulas et al. | 426/5 |
| 7,588,149 | B2 * | 9/2009 | Gelardi | 206/531 |
| 7,658,287 | B2 * | 2/2010 | Hession | 206/528 |
| 7,726,549 | B2 * | 6/2010 | Lo Duca | 229/120.18 |
| 7,735,650 | B2 * | 6/2010 | Zumbiel | 206/532 |
| 7,810,640 | B2 * | 10/2010 | Weston | 206/485 |
| 7,845,495 | B2 * | 12/2010 | Baker et al. | 206/531 |
| 7,845,496 | B2 * | 12/2010 | Hession | 206/538 |
| 7,959,005 | B2 * | 6/2011 | Berg et al. | 206/531 |

(Continued)

FOREIGN PATENT DOCUMENTS

| | | |
|---|---|---|
| DE | 8016422 | 11/1980 |
| EP | 0559167 | 3/1993 |
| FR | 2553987 | 5/1985 |
| FR | 2862291 | 5/2005 |
| GB | 2355256 | 4/2001 |

(Continued)

*Primary Examiner* — Steven A. Reynolds
(74) *Attorney, Agent, or Firm* — MWV Intellectual Property Group

(57) ABSTRACT

A container includes a base portion (11), a lid portion (12), and a hinge portion (13) connecting the base portion to the lid portion. The lid portion and/or the base portion are movable about the hinge portion between an open configuration and a closed configuration in which the lid portion overlies the base portion substantially in the form of a book. The base portion has a shell (40) attached thereto to form a sheath for receiving one or more articles (20). The sheath has an open end or outlet (44) and allows one or more articles to slide relative thereto in the direction substantially parallel to the base portion between a storage position and one or more dispensing positions.

18 Claims, 15 Drawing Sheets

(56) References Cited

U.S. PATENT DOCUMENTS

| | | | | |
|---|---|---|---|---|
| 8,011,512 | B2 * | 9/2011 | Brollier et al. | 206/531 |
| 2004/0040880 | A1 | 3/2004 | Grosskopf | |
| 2004/0050748 | A1 * | 3/2004 | Ehrlund | 206/538 |
| 2005/0183981 | A1 * | 8/2005 | Gelardi | 206/531 |
| 2006/0131205 | A1 * | 6/2006 | Sandberg et al. | 206/538 |
| 2007/0045149 | A1 * | 3/2007 | Hession | 206/538 |
| 2007/0227931 | A1 | 10/2007 | Shane | |
| 2007/0272586 | A1 * | 11/2007 | Hession | 206/532 |
| 2008/0023352 | A1 | 1/2008 | Creed | |
| 2009/0301924 | A1 * | 12/2009 | Rondeau | 206/531 |
| 2010/0084308 | A1 * | 4/2010 | Rigby | 206/531 |
| 2010/0140132 | A1 * | 6/2010 | Berg et al. | 206/531 |
| 2010/0230320 | A1 * | 9/2010 | Caron et al. | 206/531 |
| 2012/0037517 | A1 * | 2/2012 | Grosskopf | 206/1.5 |

FOREIGN PATENT DOCUMENTS

| | | |
|---|---|---|
| JP | 61-183816 | 11/1985 |
| JP | 11-292069 | 10/1999 |
| JP | 2002-302168 | 10/2002 |
| WO | WO2004037657 | 5/2004 |
| WO | WO2005028316 | 3/2005 |
| WO | WO2005030606 | 4/2005 |
| WO | WO2005049448 | 6/2005 |
| WO | WO2005068304 | 7/2005 |
| WO | WO2007021788 | 2/2007 |
| WO | WO2008112876 | 9/2008 |
| WO | WO2008124622 | 10/2008 |
| WO | WO2009013471 | 1/2009 |
| WO | WO2009029255 | 3/2009 |
| WO | WO2009114654 | 9/2009 |
| WO | WO2010011704 | 1/2010 |

* cited by examiner

CONTAINER FOR HOUSING A TRAY OR BLISTER PACK

BACKGROUND OF THE INVENTION

This disclosure relates to a container and, more particularly, a booklet-style container for housing an article such as a tray or blister pack. It also relates to a blister pack for housing in the container.

A wide variety of containers are known for holding blister packs, e.g. containing an array of pills. Commonly, the blister pack is enclosed in a carton, e.g. a cardboard container one end of which opens to enable the blister pack to be inserted therein and removed therefrom. Similarly there are containers for holding other objects such as medical devices, for example syringes, where the syringes may be held in thermoformed trays or tray structures made of paperboard.

A tray or blister pack may also be provided in a plastic sheath which is closed on three sides but open at one end. Examples of such sheaths are described in WO2004/037657, WO2005/030606 and WO2005/049448.

These containers suffer from various disadvantages: provisions for the display of compliance information (or other information) and/or the housing of a leaflet or booklet may be limited or inconvenient, and their manufacture requires the use of a relatively large amount of paperboard or plastic material in order to form a sturdy container. Some containers provide additional functionality such as devices to retain blister packs, but in turn require specialized blister packs.

SUMMARY OF THE INVENTION

For simplicity in this disclosure, a blister pack is often used as an example of a structure that may be housed in the disclosed container or containers; however, trays or tray-like structures or other articles may be housed in the container as well.

The present disclosure seeks to provide a new form of container which addresses these disadvantages and also provides for one or more of the following:

a) provide a slim, sturdy container for conveniently dispensing blister packs, tray-like structures or other articles
b) provide for a controlled dispensing of one or more articles from the container
c) provide convenient surfaces on which to print instructions, and
d) be relatively easy and inexpensive to manufacture.

A blister pack generally comprises a generally planar side formed by a foil (typically of aluminium) and a plastic layer having one or more blisters moulded therein. Each blister comprises an enclosure with an open side which is covered by the foil. Articles (such as pills) housed in said blisters can be ejected through the foil by pressing the relevant blister. Perforations may be provided in the foil in the area of each blister to facilitate rupture of a localised area of the foil as an article is ejected from a blister.

Besides blister packs, other tray-like structures are used to hold items. For examples, medical devices such as syringes may be held in thermoformed trays or trays constructed of folded paperboard.

According to a first aspect of the disclosure, there is provided a container for housing one or more articles, the container comprising a base portion, a lid portion, and a hinge portion connecting the base portion to the lid portion and about which the lid portion and/or base portion are movable between an open configuration and a closed configuration in which the lid portion overlies the base portion substantially in the form of a book, the base portion having a shell attached thereto forming a sheath for receiving the one or more articles, the sheath having an open end and being adapted to enable sliding of the one or more articles relative thereto in a direction substantially parallel to said base portion between a storage position and one or more dispensing positions.

According to a second aspect of the disclosure, there is provided a container for housing one or more articles, the container comprising a base portion, a lid portion, and a hinge portion connecting the base portion to the lid portion and about which the lid portion and/or base portion are movable between an open configuration and a closed configuration in which the lid portion overlies the base portion substantially in the form of a book, the base portion having a shell attached thereto to form a sheath for receiving the one or more articles, the sheath having an open end and being adapted to enable sliding of the one or more articles relative thereto in a direction substantially parallel to said base portion between a storage position and one or more dispensing positions, in use, said open end being covered by part of said lid portion and/or the hinge portion in said closed configuration or by a closing part carried by said article.

According to a third aspect of the disclosure, there is provided a blister pack for being housed in a container as described above, the blister pack comprising a generally planar side and a moulded part on the other side with one or more blisters for housing articles provided therein, the moulded side having an upstanding wall adjacent one end thereof extending substantially across the width of the blister pack, said wall extending away from said generally planar side by a distance substantially similar to the distance by which said one or more blisters extend away from said generally planar side.

Preferably, said shell is formed from a substantially flat sheet of material by a thermoforming process, e.g., by one or more of press moulding, vacuum moulding, pressing, and folding. The shell is then preferably secured to the base portion by welding, heat sealing and/or adhesive.

Alternatively, said shell, base portion, hinge portion, and lid portion are formed from a single substantially flat sheet of material by one or more of press moulding, vacuum moulding, pressing, and folding.

Optionally, said shell further comprises an aperture other than said open end, said aperture being adapted to allow a finger or object to be inserted therethrough to slidably move said one or more articles at least partly out of or into said shell.

The container may optionally house within the shell a tray or blister pack.

The shell may optionally have an indent for locating the tray or blister pack within the container, with the indent having an interference fit with at least one item or blister on the tray or blister pack. The indent may optionally be moulded into or pressed into the shell. In the case of a container made from a folded sheet material, the indent may optionally comprise a tab formed in the sheet material.

The shell may optionally have one or more recesses for receiving parts of a tray or blister pack, or for receiving items or blisters located on a blister pack. The shell may optionally have a slide tab or indented region to provide an interference fit with the top of an item or blister on a tray or blister pack.

In the closed configuration of the container, the open end of the shell may be closed by a gate, a tab, or a hinge portion of the container. In other arrangements, the tray or blister pack may carry an upstanding wall which closes said open end when the tray or blister pack is fully inserted into the container.

The direction of sliding may optionally be parallel to or perpendicular to a hinge axis about which the lid and base portions are rotatable.

The container may optionally have a frame portion that may include one or more of a closure gate, literature pocket, and fastening means to hold the frame and shell closed.

The shell may optionally be formed from a flat sheet of material by a thermoforming process, e.g., press moulding, vacuum moulding, pressing, and/or folding.

The shell, base, hinge and lid may optionally be formed from a flat sheet of material by a thermoforming process, e.g., press moulding, vacuum moulding, pressing, or folding.

The container may optionally have a second shell attached to the lid.

The container may optionally have a weakened portion within the hinge or base by which the hinge and lid may be removed from the base and shell.

The container may optionally comprise a depending edge on the base or lid, engaged by a protrusion on the lid or base when the container is closed. The depending edge may optionally comprise an aperture or indentation to engage the protrusion. The depending edge may optionally be perpendicular to the lid or base to which it is attached. The protrusion may optionally be generally parallel to the lid and base and located between the lid and base when the container is closed.

As will be described further below, the container provides several advantages over prior art containers such as those mentioned above. In certain embodiments, a standard blister pack can be accommodated, that is, having no special features other than conventional blisters mounted on a planar substrate with at least a portion of some edges extending beyond the blisters. In certain embodiments, the shell of the container may incorporate indents, tabs, or other devices that have a loose interference fit with the blisters themselves or with other features of the tray or blister pack so as to allow the tray or blister pack to be indexed by steps out of the shell. In certain embodiments, the shell is provided with an access or cutout area by which to move the tray or blister pack out of or into the shell. In certain embodiments, portions of the shell may be formed to allow a close sliding fit with the edges of the tray or blister pack to provide a smooth sliding action and secure retention of the tray or blister pack against unwanted motion within the container.

The container may be formed from a sheet material and a moulded material, or entirely from a sheet material, for example by folding. The sheet material may be paperboard, plastic or other planar material, preferably being somewhat stiff and suitable for printing one or both sides. The moulded material if used may be plastic, paperboard, or other material, preferably having at least a slightly rigid structure to provide packaging strength. The moulded material may for example be a thermoformed plastic, or a pressed paperboard material. It is understood that thermoforming and pressing processes may involve the application to the material of one or more of heat, pressure, and vacuum, and in the case of certain materials like paperboard, of moisture. Thus, a sheet portion of the container, such as the base or lid, may be folded from a blank cut from a substantially flat sheet or roll of material. The shell and frame portions may also be formed by a moulding process, e.g. vacuum moulding or injection moulding. In some cases, such techniques may also be used together, e.g. a preform may be made by vacuum moulding or injection moulding technique and then parts of the container folded to create the base portion and/or lid portion thereof.

In the container, the lid portion and base portion each extend over a major face of the container (rather than a minor face thereof). The separation between the lid and base portions is sufficiently deep (in a direction perpendicular to their major face, in certain embodiments approximately equal to the width of a hinge portion) to house a shell to contain a blister pack. The hinge portion is preferably connected to the lid portion by a first fold line and to the base portion by a second fold line (so the hinge portion comprises two, parallel fold lines).

Generally, the lid and base portions comprise a substantially rectangular major face. Preferably, the depth of the container is relatively small compared to the length and/or width of the container. The container may thus have the form of a clamshell. In a clamshell container, the lid portion and base portion each extend over a major face of the container (rather than a minor face thereof). In addition, both the lid and base portions are sufficiently deep (in a direction perpendicular to their major face) to house an article (for instance a blister pack or a booklet). Generally, the lid and base portions comprise a substantially rectangular major face with side walls around the periphery thereof (or around at least part of the periphery). In many cases, the lid portion and base portion are of similar depth so the line at which the side walls thereof abut each other is substantially central (although, in some cases, the side walls of the base and lid portions may nest within each and thus overlap). Preferably, the depth of the container is relatively small compared to the length and/or width of the container.

Other exemplary and optional features of the disclosure will be apparent from the following description and from the subsidiary claims. Features of Claims 26 to 29 may be applied, mutatis mutandis, to a tray for inserting in said container.

BRIEF DESCRIPTION OF THE DRAWINGS

Various embodiments of the present disclosure will now be further described, merely by way of example, with reference to the accompanying drawings, in which:

FIG. 3A is a perspective view of the container in the closed configuration and FIGS. 3B and 3C are perspective views from different angles of the container in the open position, wherein a blister pack is shown in the storage position;

FIGS. 4A and 4B are perspective views from different angles of the container in the open position. FIG. 4A shows a blister pack in the storage or fully inserted position while FIG. 4B shows the blister pack slightly withdrawn from the container but not having arrived at a dispensing position. FIG. 4C corresponds to FIG. 4B but shows the blister pack withdrawn from the container. FIG. 4D is a perspective view of the container in the closed configuration.

FIGS. 5A and 5C are perspective views from different angles of the container in the open position.

FIG. 5B shows a plan view of the container in the open position. FIG. 5D is a perspective view of the container in the open position with the blister packs shown withdrawn from the container. FIG. 5E is a perspective view of the container with one blister pack withdrawn and showing a leaflet removed from the container. FIG. 5F is a perspective view of the container in a partially closed configuration and FIG. 5G is a perspective view of the container in the closed configuration.

FIG. 10 is a plan view of a blank for forming the container of the seventh embodiment. FIG. 11 is a perspective view of a partially erected container and a blister pack to be loaded into the container through the outlet. FIG. 12 is a perspective view of a fully erected container in the closed form. FIG. 13 is a perspective view of the container of FIG. 12 shown in a different angle and showing upper closure flaps being removed along tear lines. FIG. 14 is a perspective view of the container of FIG. 12 in the opened position after the upper closure flaps have been removed.

FIG. 15 is a perspective view of a container of the modified form, showing the side closure flaps in a pre-glued condition. FIG. 16 is a perspective view of the container of FIG. 15, showing the side closure flaps in the process of their removal from the container.

DETAILED DESCRIPTION OF THE PREFERRED EMBODIMENTS

Figure 1:
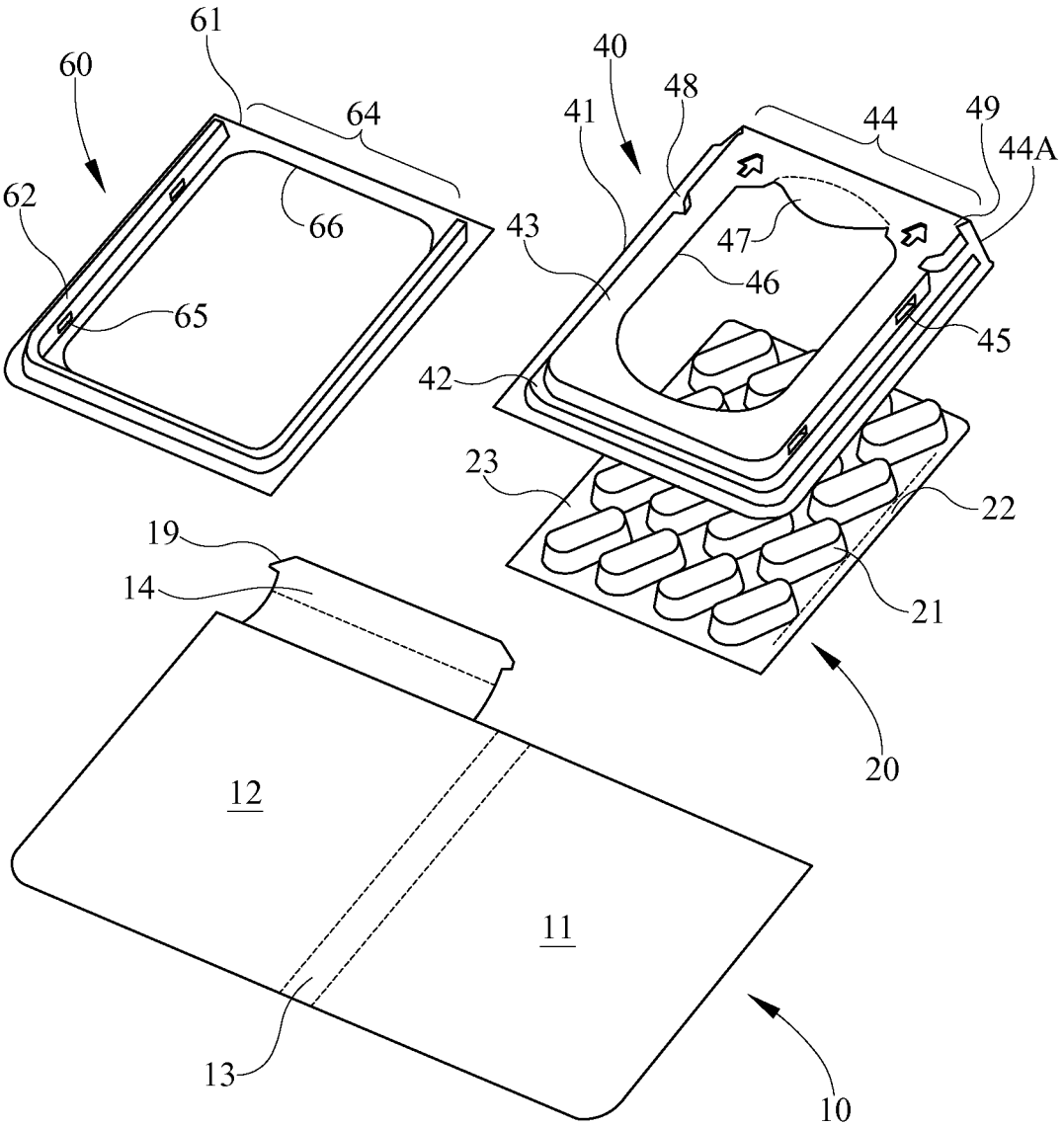
FIG. 1 is a perspective, exploded view of major parts of a first embodiment of a container according to the present disclosure showing the container component parts not yet joined together, and with a blister pack shown in proximity thereto.
Figure 2A:
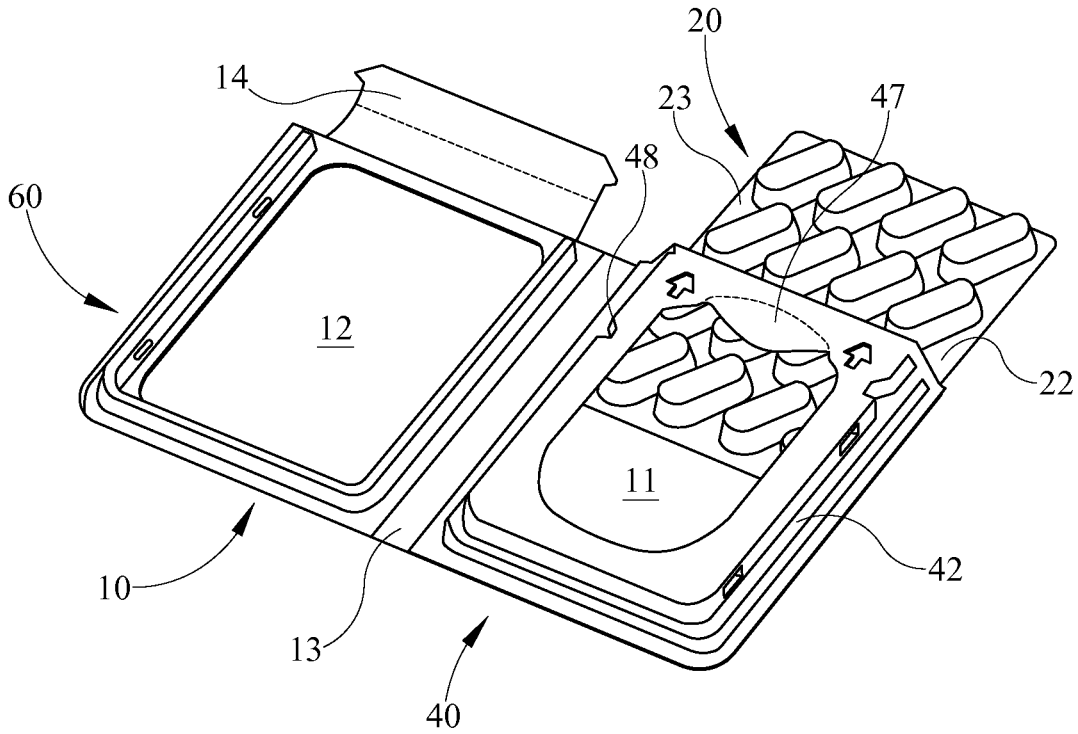
FIG. 2A is a perspective view corresponding to FIG. 1 after the major parts have been joined together, in an open configuration, and with a blister pack shown in a dispensing or partially inserted position.
Figure 2B:
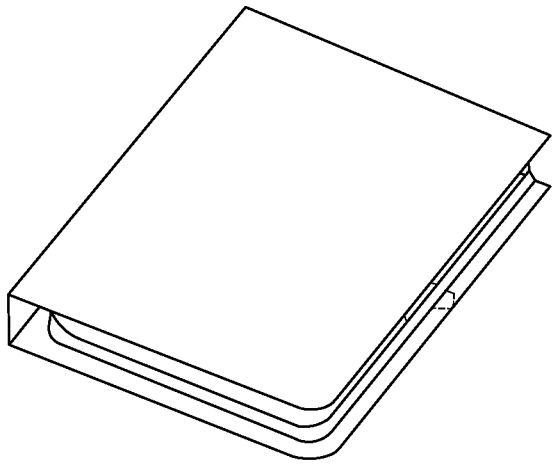
FIG. 2B is a perspective view corresponding to FIG. 1, with the finished container in a closed configuration.

FIGS. 1, 2A and 2B show a first embodiment of a container comprising a cover 10, a shell 40, and a frame 60. The cover 10 may be formed from a sheet material such as paperboard, and comprises a base portion 11, a lid portion 12 and a hinge portion 13 that connects the base portion 11 to the lid portion 12 at first and second fold lines. A structure similar to a book cover is thus formed, which may be printed on one or both sides. Attached to one edge of lid 12 is a closure flap 14 with a closure tooth 19 (although, as described further below, this flap may be omitted in some embodiments).

A shell portion 40 is provided that may be a thermoformed plastic or pressed paperboard structure. The shell portion 40 may also be provided by other means such as, for example, injection moulding. The shell portion attached to the base portion thus forms a sheath for holding contents within this container and other containers disclosed herein. The shell portion 40 has a shell sealing surface 41, for example, for heat sealing or otherwise attaching to base 11. The shell portion 40 has an interior volume defined in part by a first recess 42 adjacent to base 11, and a second recess 43. The second recess 43 as shown is deeper than the first recess 42. One end of shell 40 is open as shell outlet 44. One or more raised area or shell catches 45 may be provided around the outside of the side lateral walls of the second recess 43. The shell portion 40 may also be secured to the base 11 by welding and/or by adhesive via sealing surface 41.

The upper surface of second recess 43 has a shell cutout area 46 for access to the interior of the shell. Shell cutout area 46 may be large enough for a finger to be inserted therethrough to move contents such as blister pack 20. A restricting feature in the form of a slide tab 47 may be provided on an edge of the cutout area 46, from which the slide tab 47 is formed so as to ride with light pressure upon the tops of blisters 21. On the periphery of second recess 43 may be provided one or more indexing elements (in the form of indents 48) which interfere slightly with movement of blisters 21 so as to allow blister pack 20 to be moved in shuttle fashion in and out of shell 40. One or more of shell 40, indexing indent 48, and blister 21 are formed so as to flex slightly under an applied force, such as pressure from finger inserted through shell cutout areas 46 to move the blister pack in or out of shell 40.

Shell cutout area 46 may have a different shape or size than the example shown in FIG. 1. A larger shell cutout area potentially provides more visibility for information printed on the inside of base 11, and more area upon which to push on the blister pack 20 to move it into or out of shell 40. In certain embodiments, the shell cutout area 46 may be wide enough for a fingertip or portion of a fingertip to contact one or more blisters 21 and thereby move blister pack 20 out of, or into, shell 40. Thus, the shell cutout area may have a length (in the direction of blister pack movement) at least as long as the pitch between blisters in that direction. The cutout area may optionally extend onto one or both side walls of the shell, or onto the end wall of the shell, i.e., at the opposite end to the outlet 44. The cutout area may also comprise more than one opening.

A relatively small shell cutout area may provide more protection of blister pack 20, and may provide more strength to the container. Preferably the upper surface of shell 40 remaining beyond shell cutout area 46 is sufficient to at least partially overlap the side rows of blisters 21. Sufficient material may be left after removing shell cutout area 46 so that at least about one quarter of the side blisters is covered by the shell.

Figure 3A:
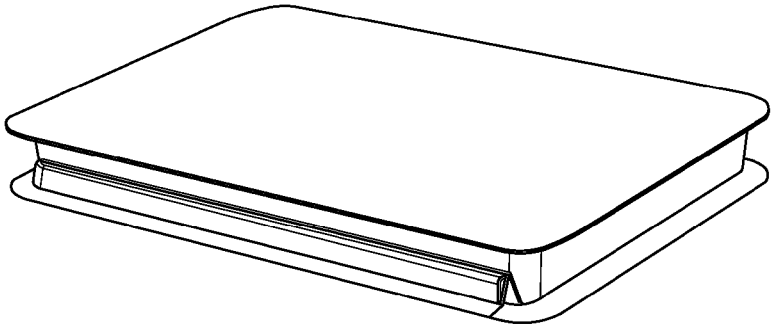
FIGS. 3A-3B show a second embodiment of a container according to the present disclosure.
Figure 3B:
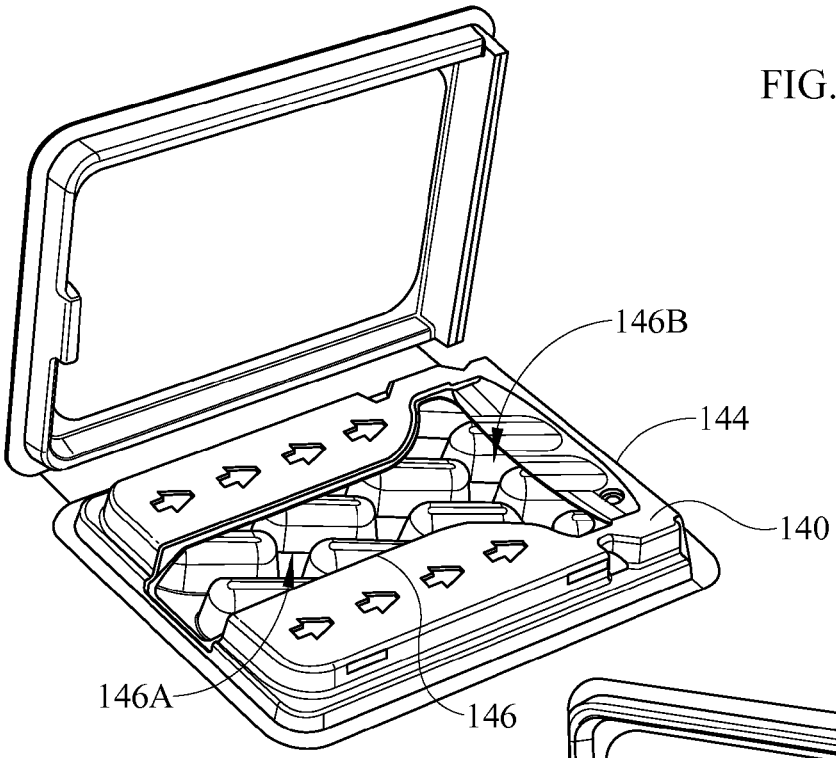
Figure 3C:
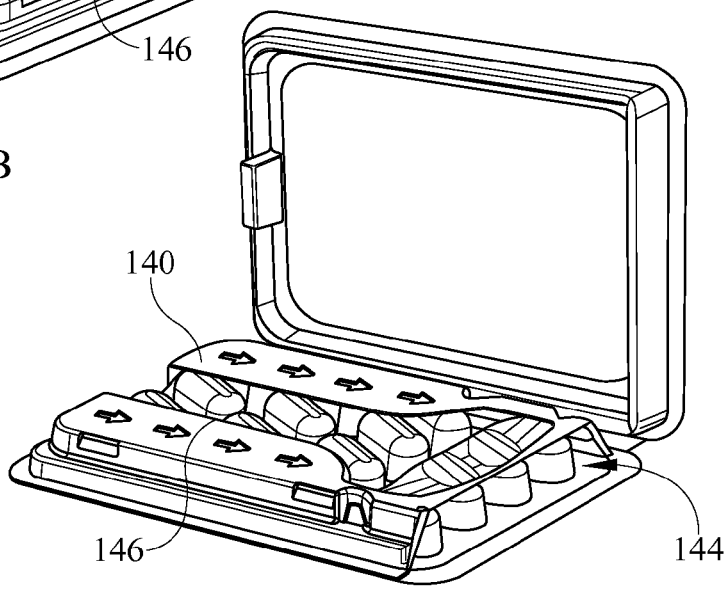

FIGS. 3A-3C show a second embodiment of a container similar to the container of the first embodiment. The container of the second embodiment has a generally T-shaped cutout 146 with a longitudinal portion 146A which extends along the length of the shell 140, and into an end wall thereof. The cutout 146 also has a lateral portion 146B adjacent the outlet 144 which extends across the width of the shell 140.

Returning to the first embodiment, a frame portion 60 is provided that may be a thermoformed plastic or pressed paperboard structure. The frame portion 60 may also be provided by other means such as, for example, injection moulding. The frame portion 60 has a frame sealing surface 61, for example, for heat sealing or otherwise attaching to lid 12. The frame portion 60 has a frame rail 62, shown in approximately "U" shape, and open at one end with frame outlet 64 facing the same direction as shell outlet 44. The frame 60 may have a frame cutout area 66, for example to allow visibility of information printed on the inside of lid 12. One or more depressed area or frame catch 65 may be provided around the inside of frame rail 62. While frame rail 62 is shown as a continuous "U" shape, which provides good strength and stability, other configurations are possible, such a discontinuous frame rail, a frame rail having two sides instead of three, etc.

The blister pack 20 has a generally planar face (on the underside in the view shown) comprising a rupturable sheet of foil and an array of blisters 21 on the opposite face (the upper face in the views shown) for housing articles, e.g. pills. Such blister packs are well known so will not be described further. The blister pack may be installed in the container at a stage during manufacture of the container or may be inserted at a later stage.

The blister pack is provided with peripheral portions 22, 23 along each side thereof and, as are typically provided for convenience and to ensure a good seal around blisters located at the edges of the blister pack. These peripheral portions 22, 23 may be used advantageously in a sliding fit within certain recesses of the container, as will be described.

During the making of shell 40, a cutting operation such as die-cutting or guillotining may be used to create the opening for shell outlet 44. To facilitate cutting of the shell material, the sides of shell 40 may be sloped as shown by slope 44A. Such a slope may for example help prevent crushing that may occur if a straight vertical wall is cut.

FIG. 2A shows an assembled container where shell 40 has been attached to base 11, for example by heat sealing, and frame 60 has been attached to lid 12, for example by heat sealing. In the first embodiment, the sealing surface 41 is provided around three sides of the shell 40 but does not extend across the open end 44 of the shell. In other embodiments (not shown), the sealing surface 41 may extend around all four sides of the shell 40. The outlet 44 is thus set back from the edge of the base 11 by the width of the sealing surface 41. In this case, the outlet 44 comprises an aperture formed though the shell 40 so is more suited to forming by die-cutting than guillotining. This arrangement strengthens the attachment of the shell 40 across the open end thereof to the base 11 so it is less vulnerable to attempts to peal the base 11 away from the shell 40.

FIG. 2A shows a blaster pack 20 in a dispensing position, or partially inserted position, relative to the container. Therefore, a portion of the interior surfaces of base 11 is visible through the shell cutout area 46. A portion of the interior surface of the lid 12 is also visible through the frame cutout area 66. A blister pack 20 may be inserted into shell 40 through shell outlet 44.

The lid 12 and base 11 are connected by hinge portion 13, through which the lid and base may fold or hinge to a closed configuration shown in FIG. 2B in which the lid overlies the base portion substantially in the form of a book. In the closed configuration, the shell catch 45 and frame catch 65 may engage in a snap fit to help hold the container closed. Once the blister pack 20 has been inserted into shell 40, and the lid 12 with frame 60 closed upon base 11 and shell 40, the closure flap 14 (if provided) may be foldably inserted into the container to close the container. To help hold the closure flap in the closed position, closure tooth 19 may engage closure notch 49 located in the shell 40.

During manufacture of the container shown in FIGS. 1, 2A and 2B, there are several methods by which the blister pack 20 can be inserted. Having formed the structure, blister pack 20 may be inserted into the open configuration shown in FIG. 2A. Alternately, blister pack 20 may be inserted into the closed configuration shown in FIG. 2B, before the closure flap 14 is folded into place. Another option is to form or place the shell 40 in an inverted position with its first recess 42 and second recess 43 facing upward, drop or place the blister pack into the shell 40, then attach base 11 onto the shell. Thus, this embodiment of the container is quite flexible with regard to filling processes.

In arrangements not having a closure flap 14, outlet 44 of the container remains open when the container is in the closed configuration. In this case, as will be described further below with reference to FIGS. 4A to 4D, the blister pack 20 may be provided with an upstanding wall which, when the blister pack is fully inserted into the container, closes the outlet 44. With the arrangement, the blister pack can 20 also be inserted into the container when in the closed configuration shown in FIG. 2B.

Shell 40 and frame 60 may be separately formed, and separately joined onto base 11 and lid 12 respectively. Alternately, shell 40 and frame 60 may be formed in one piece and simultaneously attached to the base 11 and lid 12.

Since the first recess 42 is wider and shallower than second recess 43, the first recess 42 may be used to provide a guide slot or guide slots for the blister pack peripheral edges 22, 23. This helps stabilize or guide the sliding motion of blister pack 20, and helps retain blister pack 20 against excessive movement within the container. The depth of first recess 42 may therefore be designed to allow fairly close fit with the blister pack peripheral edges 22, 23.

Since the second recess 43 is narrower and deeper than first recess 42, the second recess 43 may be used to provide good fit for the blisters 21. This also helps stabilize or guide the sliding motion of blister pack 20, and helps retain blister pack 20 against excessive movement within the container. The depth of second recess 43 may therefore be designed to allow a fairly close fit with the upper surfaces of the blisters 21, while the width and depth of second recess 43 may be designed to allow a fairly close fit with the lateral surfaces of the outer rows of blisters 21. Furthermore, slide tab 47 may be designed to provide a light pressure upon the tops of blisters 21.

FIGS. 4 to 7 show further embodiments of a container for housing one or two blister packs. These embodiments are provided with locking features to provide some child-resistance to the container. In particular, a first locking feature is provided to lock the blister pack within the container so as to prevent access to the underside of the blister pack until the lock has been released. A second locking feature is also provided to prevent the blister pack from being completely withdrawn (i.e., separated) from the container.

FIGS. 4A to 4D show a third embodiment of a container. The general structure of the container of the third embodiment is similar to that of the container of the first embodiment. However, an aperture 240A is provided in the shell 240 to receive an engagement or hook member 220A provided on blister pack 220. When the blister pack is fully inserted in the container, the hook member 220A engages in the aperture 240A so as to prevent the blister pack from being slid out of the outlet 244. To be able to slide the blister pack out, it is first necessary to depress the hook member 220A towards the base 211 to disengage it from the aperture 240A.

The hook member is shaped so that one side thereof (the leading edge when it is being inserted) is inclined or curved whereas the other side (the leading edge when it is being withdrawn) is substantially vertical (or is undercut) so as to engage securely with an edge of the aperture 240A. Other versions of the engagement or hook member will be described in relation to FIGS. 8 and 9.

Figure 8:
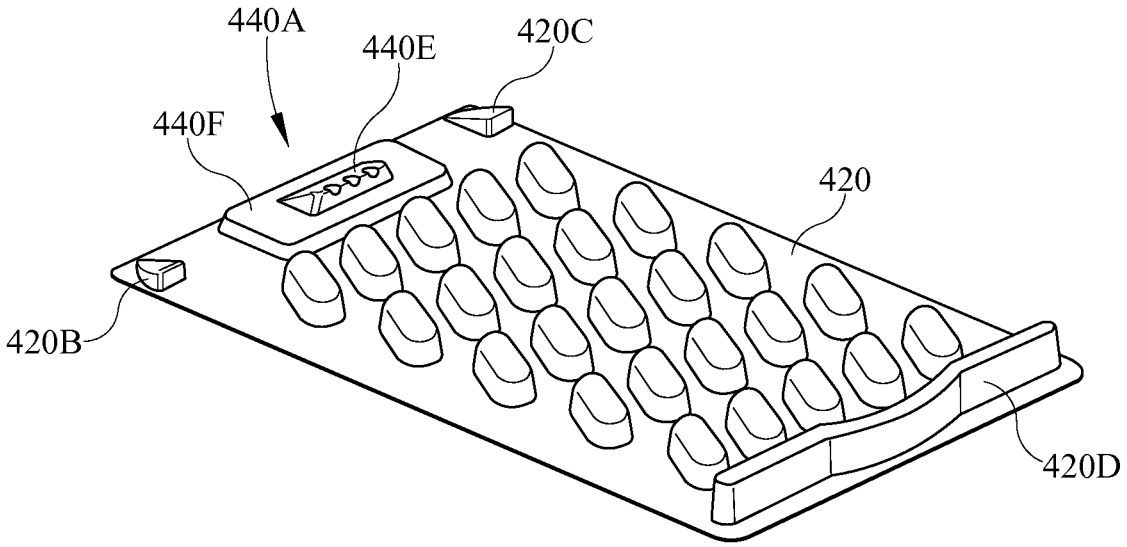
FIG. 8 is a perspective view of a preferred form of blister pack for use in containers such as those described above in relation to FIGS. 4 to 7.
Figure 9:
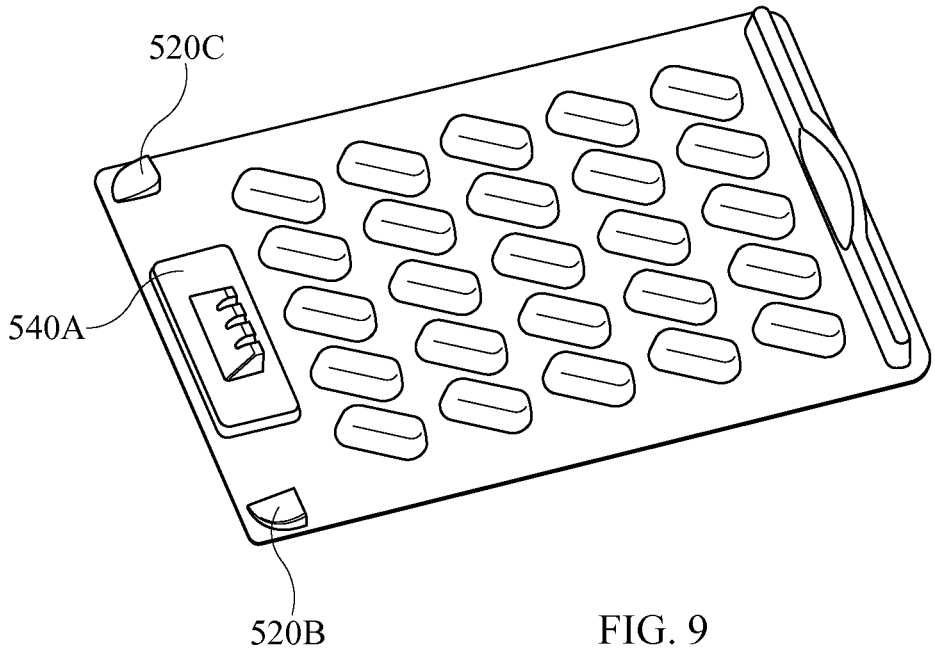
FIG. 9 is a perspective view (from a different angle) of a variant of the blister pack shown in FIG. 8.

The blister pack is also provided with two wedge-shaped projections 220B and 220C on the end that is inserted into the container, adjacent the corners thereof (see FIGS. 8 and 9 for similar projections 420B, 420C, 520B, 520C). These projections engage apertures 240B and 240C provided in the shell 240 adjacent the outlet 244 thereof to prevent the blister pack being completely withdrawn (detached) from the container (see FIG. 4C).

Figure 4A:
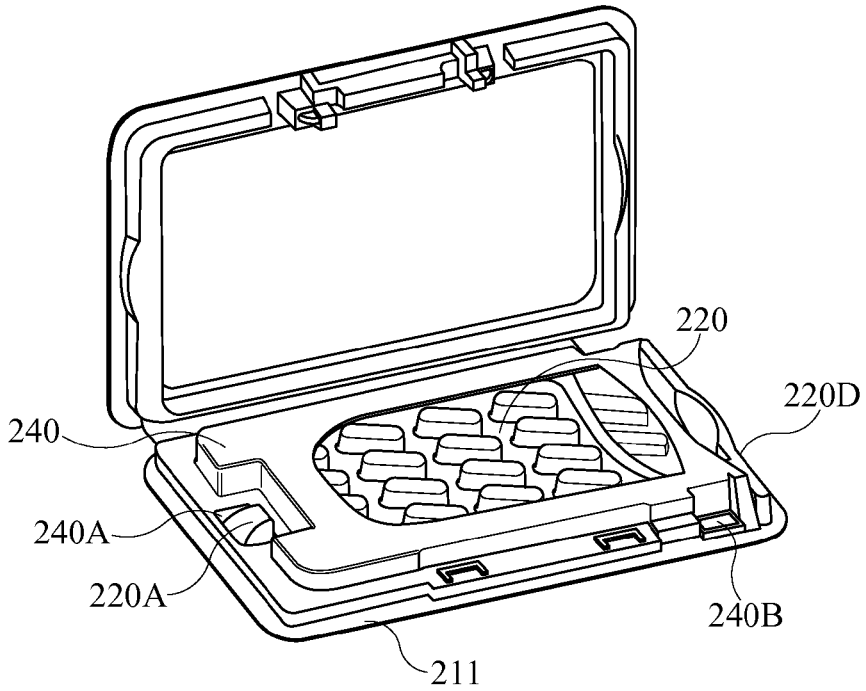
FIGS. 4A-4D show a third embodiment of a container according to the disclosure.
Figure 4B:
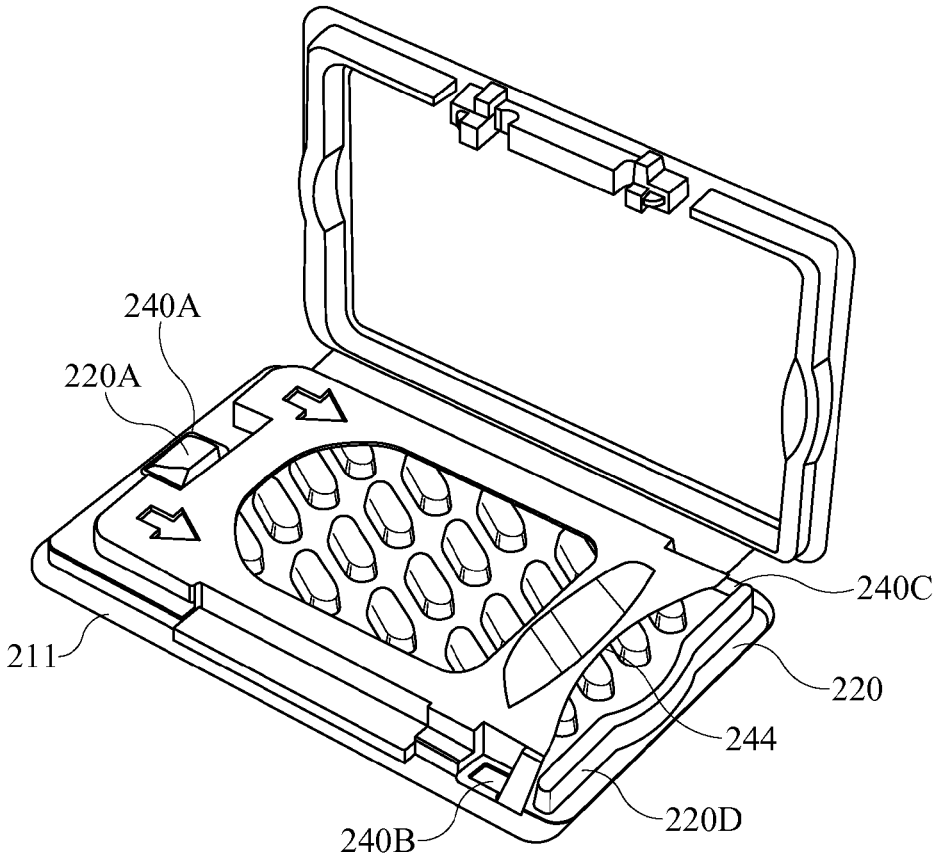
Figure 4C:
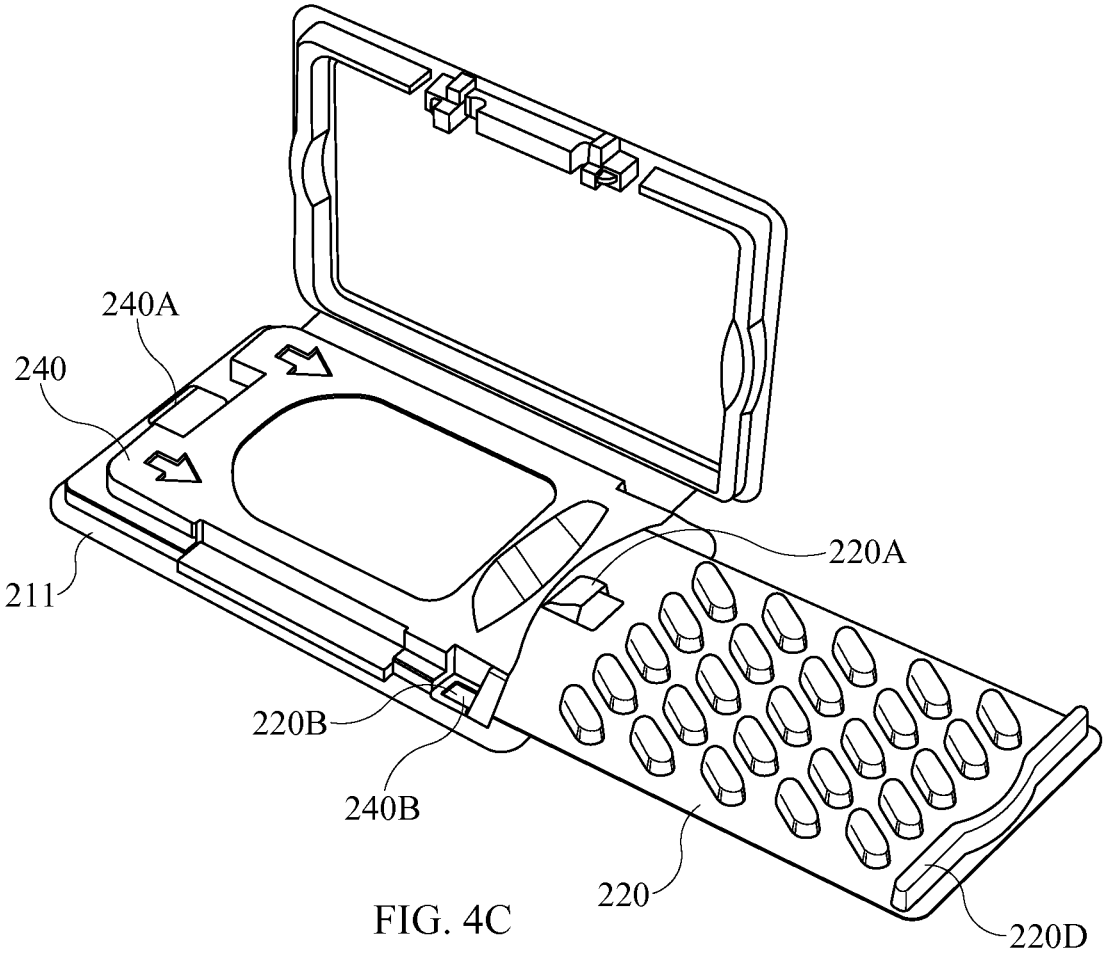
Figure 4D:
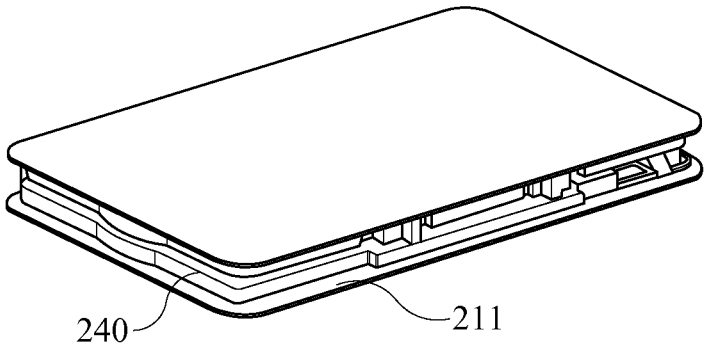

When the container is closed (as shown in FIG. 4D), the blister pack 220 and, in particular, the hook member 220A is concealed. The blister pack 220 is also provided with an upstanding wall 220D which serves to close the outlet 244 when the blister pack is inserted into the container. A central part of the wall 220D is shaped to assist engagement thereof by a finger for pulling the blister pack out of the container.

FIGS. 5A to 5G show a fourth embodiment of the container. The fourth embodiment is similar to the third embodiment shown in FIGS. 4A to 4D except that a shell 340 is provided on both the lid and the base so it can house two blister packs 320. Also, neither shell is provided with a cut-out corresponding to the cut-out 46 of FIG. 1. Instead, a recess 346 is provided in each of the shells 340 for receiving a label or a booklet 350. Each blister pack again has a hook member 320A for engaging an aperture 340A in each shell 340.

Figure 5A:
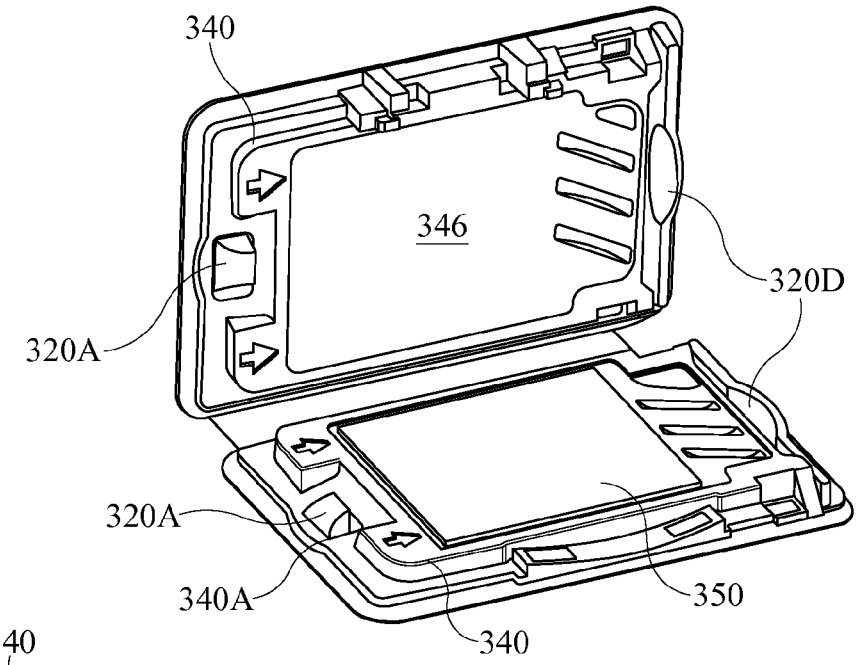
FIGS. 5A-5G show a fourth embodiment of a container according to the present disclosure for holding a blister pack in the base and the lid.
Figure 5B:
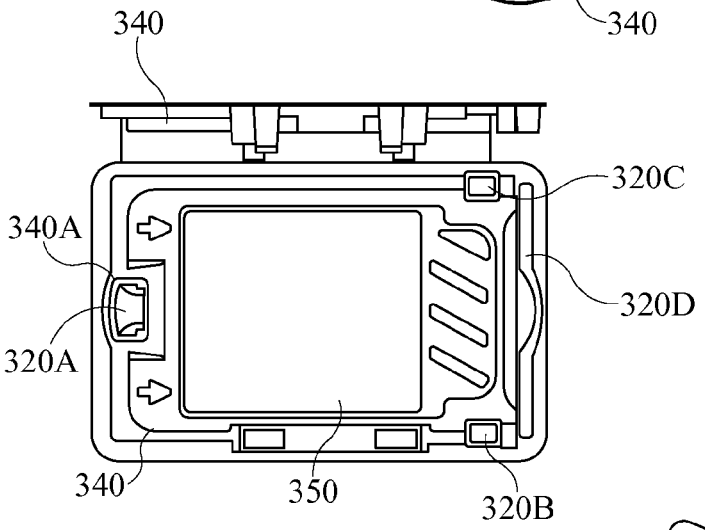
Figure 5C:
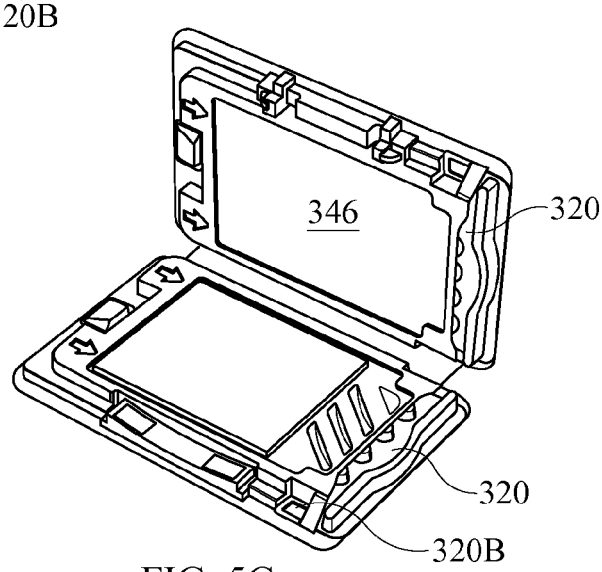
Figure 5D:
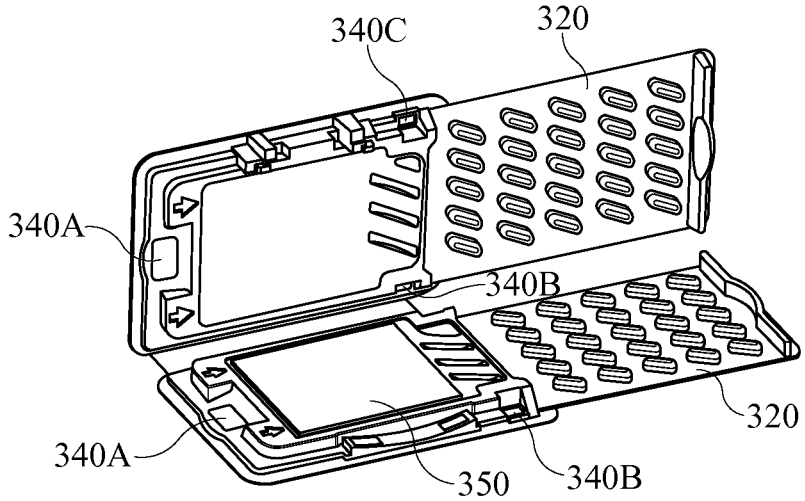
Figure 5E:
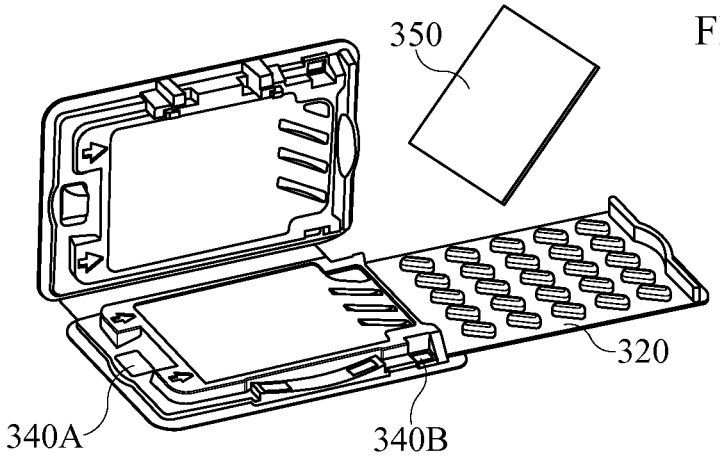

Wedge shaped projects 320B and 320C are again provided on each blister pack to engage in apertures 340B and 340C in the respective shell 340 when the blister packs 320 are fully withdrawn (as shown in FIGS. 5D and 5E).

Figure 5F:
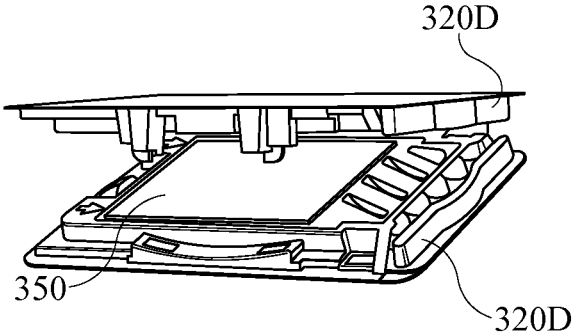
Figure 5G:
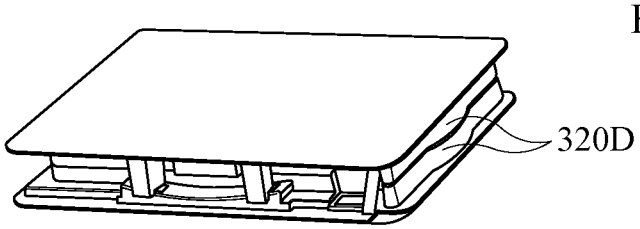

When the container is closed, the walls 320D of the two blister packs 320 engage each other to close the outlets of the shells (or sheaths) 340 and so conceal the blisters of the blister pack (see FIGS. 5F and 5G).

Figure 6A:
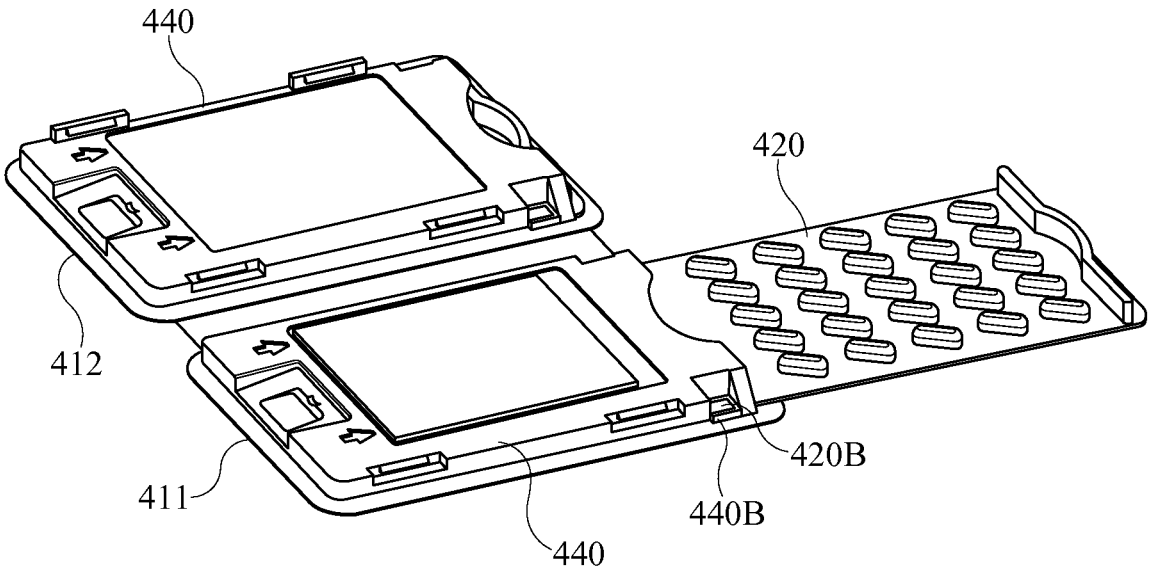
FIG. 6A is a perspective view of a fifth embodiment of a container according to the disclosure shown in the open position with a blister pack in a withdrawn position.
Figure 6B:
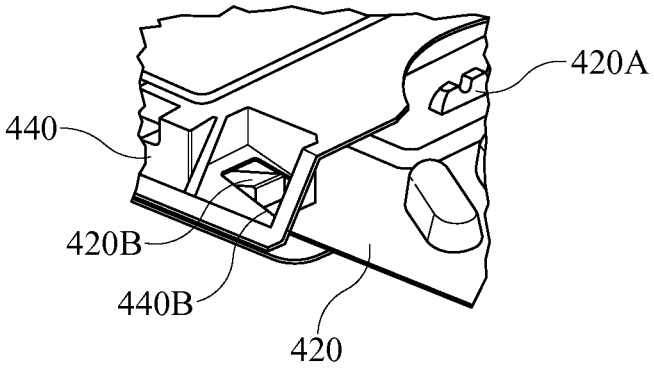
FIG. 6B is an enlarged perspective view (from a different angle) of part of FIG. 6A.

FIGS. 6A and 6B show a fifth embodiment of the container. The fifth embodiment is similar to that shown in FIGS. 5A to 5G but with some minor variations to the shape of the sheaths 440 and the catches thereon for releasably holding the lid 412 and base 411 in a closed position. FIG. 6A shows the blister pack 420 in the base 411 when fully withdrawn while FIG. 6B is an enlarged fragmentary view showing engagement of the wedge-shaped projection 420B in the aperture 440B adjacent the outlet of the container. The hook member 420A is also visible in FIG. 6B. The hook member 420A has a different form from the hook member 340A of FIG. 5A and will be described further in relation to FIGS. 8 and 9.

Each of the embodiments described above may be provided with indents similar to those described in relation to FIGS. 1, 2A and 2B which resiliently engage the blisters as they pass the indents so as to provide an indexing function whereby the blister pack is releasably held in a plurality of dispensing positions as it is withdrawn from the sheath.

Figure 7A:
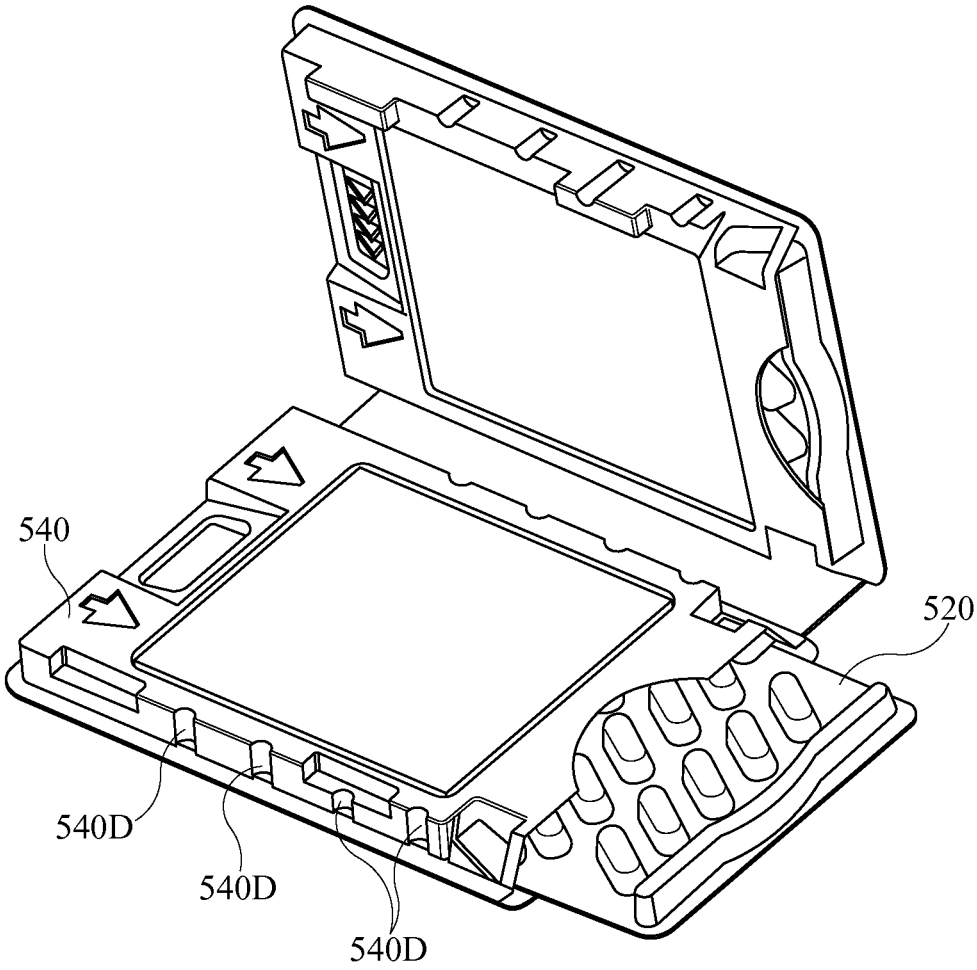
FIGS. 7A and 7B show perspective views of a sixth embodiment of a container according to the disclosure shown in the open and closed configurations, respectively.
Figure 7B:
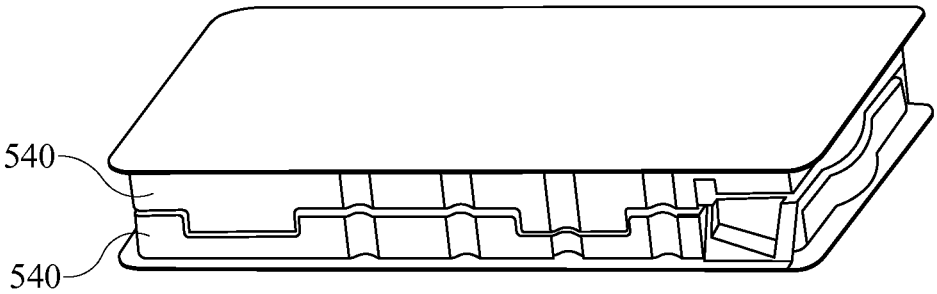

FIGS. 7A and 7B show a sixth embodiment of the container. This embodiment is similar to that of FIGS. 6A and 6B except for the provision of a different form of indexing elements. In this case, a series of indents 540D are provided along the opposite sides of the shell 540 which are resiliently engaged by the wedge-shaped projections 520B and 520C (see FIG. 9) on the blister pack 520 as these are slid past the indents 540D. For this purpose, the outer sides of the wedge-shaped projections 520B and 520C are preferably curved as shown in FIG. 9. FIG. 7B shows this container when in the closed configuration.

FIG. 8 shows a blister pack 420 such as that used in the container shown in FIGS. 6A and 6B. In addition to the blister for housing pills, this has an upstanding wall 420D for closing the outlet of the container as described above. It also has two wedge-shaped projections 420B and 420C for providing the second locking feature described above, i.e., to prevent complete withdrawal of the blister pack from the container (so it cannot be separated therefrom). It also has an engagement or hook member 440A. In this case, the engagement or hook member 440A comprises a substantially wedge-shaped part 440E mounted atop a relatively wide raised platform 440F. The wedge-shaped part 440E has a substantially vertical face on one side for engaging an aperture in the shell (as described above) and a sloping face on the other side to assist in insertion of the blister pack into the sheath. The raised platform 440F provides a resilient support, or cushion, so that finger pressure applied to the wedge shaped part 440E can depress the latter downwards (towards the base of the container). All these features can be formed in the blister pack by thermoforming techniques in a similar manner to which the blisters are formed.

In the embodiment described in relation to FIGS. 5A to 5G, the hook like member 320A is formed by forming a curved projection in the blister pack and then cutting a portion of this away to provide the vertical or undercut face of the hook.

The blister pack shown in FIG. 9 is similar to that shown in FIG. 8 except that the outer sides of the wedge-shaped parts 520B and 520C are curved for the reason described in relation to FIGS. 7A and 7B.

In other embodiments (not shown), the hook member may be provided by an end portion of the blister pack folded back on itself so the edge of the folded portion engages the aperture in the shell (or some other feature of the shell).

Other forms of locking features may be provide between the shell and the blister pack whereby they engage in a manner which resists withdrawal of the blister pack until released by the application of pressure in one or more positions or direction to the container and/or to the blister pack.

For embodiments not provided with the first locking feature described, it may be desirable to provide engagement means between the shell and the blister pack for releasably holding the blister pack in the sheath (particularly in containers in which the outlet of the sheath is closed only by a wall on the blister pack.) In the latter case, a snap fit may be provided between the wall on the blister pack and part of the lid which is aligned with the wall when the blister pack is fully inserted in the container.

Figure 10:
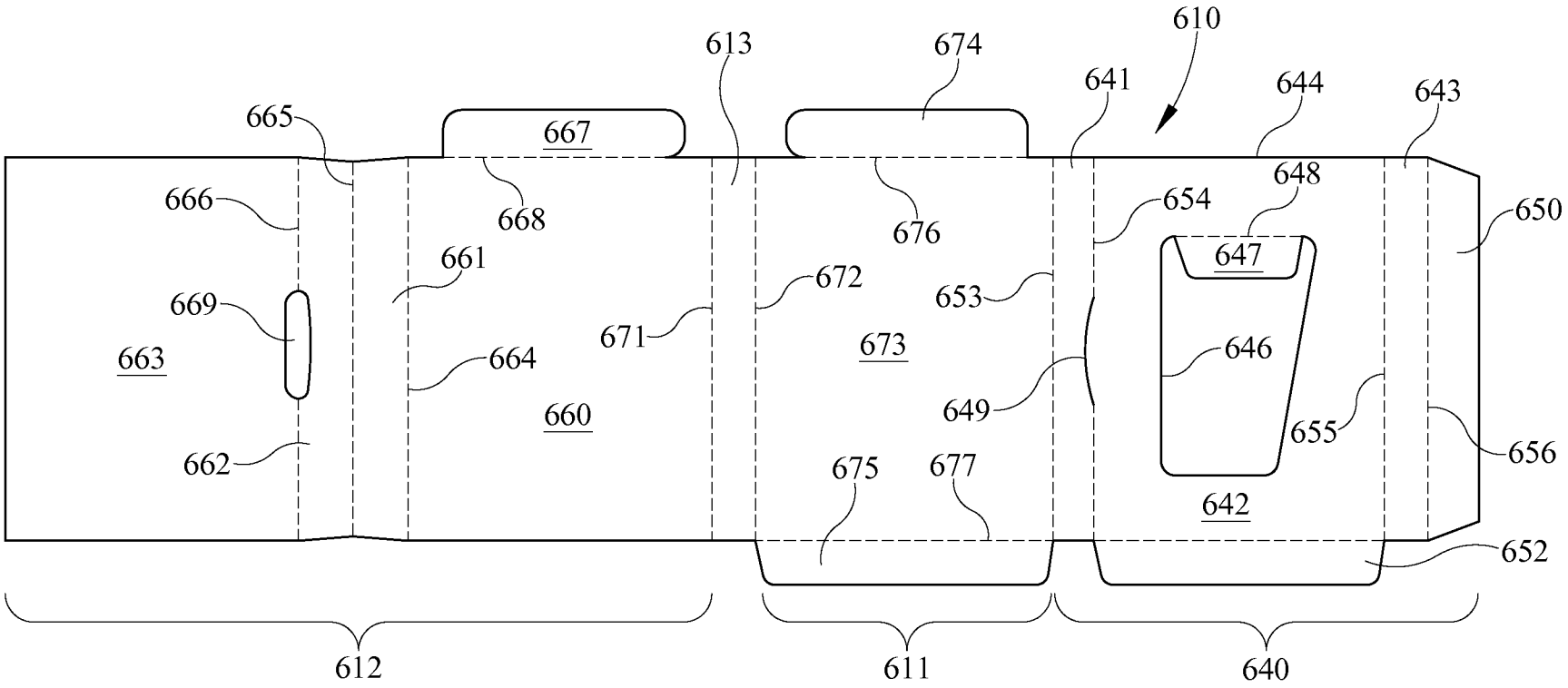
FIGS. 10-14 show a seventh embodiment of a container according to the present disclosure.

FIGS. 10 to 14 show a seventh embodiment of the container. The container of this embodiment is formed entirely from foldable sheet material such as cardboard, paperboard, corrugated board, plastic, paper-plastic composite material or the like. FIG. 10 illustrates a blank 610 as viewed from its inside surface, from which the container of this embodiment is formed. The blank 610 may be printed on one or both sides. The blank 610 comprises a base portion 611, a lid portion 612, a hinge portion 613 and a shell portion 640. The hinge portion 613 connects the base portion 611 to the lid portion 612 at first and second fold lines 671 and 672.

The base portion 611 includes a primary base panel 673, a first upper closure flap 674 and a first lower closure flap 675. The upper and lower closure flaps 674, 675 are hingedly connected to the primary panel 673 along a tear line 676 and a fold line 677 respectively.

The lid portion 612 includes an outer lid panel 660, an outer side panel 661, an inner side panel 662 and an inner lid panel 663. The outer lid panel 660 is hingedly connected to the hinge portion 613 along the fold line 671. The outer side panel 661 is hingedly connected to the outer lid panel 660 along a fold line 664. The inner side panel 662 is hingedly connected to the outer side panel 661 along a fold line 665. The inner lid panel 663 is hingedly connected to the inner side panel 662 along a fold line 666. A second upper closure flap 667 is hingedly connected to the outer lid panel 660 along a tear line 668. An engaging slot 669 is disposed astride the fold line 666 such that the slot 669 interrupts the fold line 666 and defined in both the inner side panel 662 and the inner lid panel 663.

The shell portion 640 includes a first shell side panel 641, a primary shell panel 642, a second shell side panel 643, and a glue flap 650. The first shell side panel 641 is hingedly connected to the primary base panel 673 along a fold line 653. The primary shell panel 642 is hingedly connected to the first side panel 641 along a fold line 654. The second shell side panel 643 is hingedly connected to the primary shell panel 642 along a fold line 655. The glue flap 650 is hingedly connected to the second shell side panel 643 along a fold line 656. Attached to the lower edge of the primary shell panel 642 is a second lower closure flap 652. The shell portion 640 is designed to be folded inwardly along the fold lines 653, 654, 655, 656 and to be attached to the primary base panel 673 by means of the glue flap 650 so that a sheath for holding contents is provided by the shell portion 640 and the base portion 611. The glue flap 650 may be secured to the inside surface of the primary base panel 673 by any adhesive, tape or mechanical securing means such as staples. The upper edge of the shell portion 640 defines a shell outlet 644.

The primary shell panel 642 has a shell cutout area 646 for access to the interior of the sheath. Shell cutout area 646 may be large enough for a finger to be inserted therethrough to move the contents (such as a blister pack) of the sheath. The cutout area is provided with an indexing element in the form of an indexing tab 647. The indexing tab 647 serves similarly to the indexing indents 48 described in relation to FIGS. 1, 2A and 2B in that it resiliently engages the blisters of a blister pack as they pass the indexing tab 647 so as to provide an indexing function whereby the blister pack is releasably held in a plurality of dispensing positions as it is withdrawn from the sheath.

Figure 14:
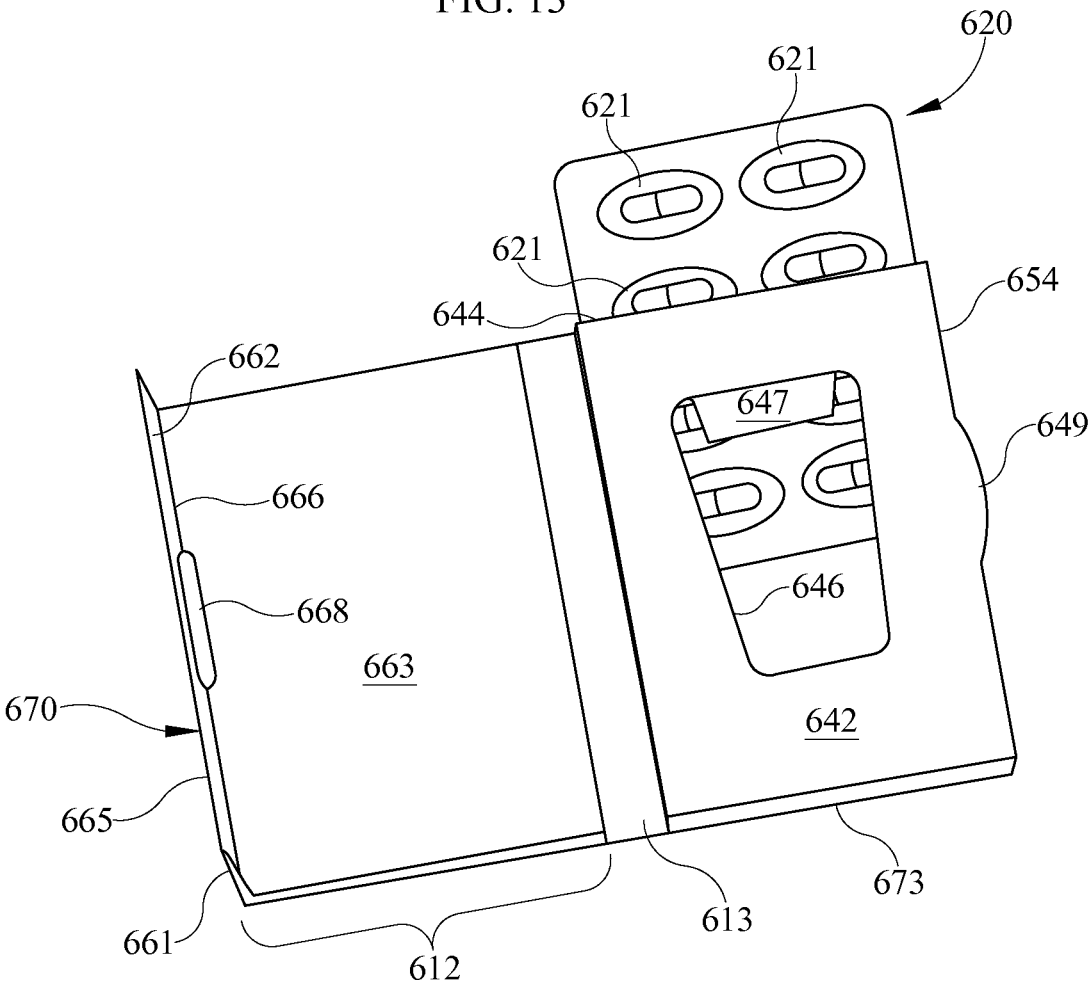

The indexing tab 647 is connected on an edge of the cutout area 646 along a fold line 648. The indexing tab 647 is struck from the primary shell panel 642 and extends into the cutout 646. When a container is erected from the blank 610, the indexing tab 647 is folded inwardly of the sheath to be disposed between two adjacent rows of the blisters 621 of a blister pack 620 received in the sheath so as to interfere with movement of the blister pack 620. This is best shown in FIG. 14. However, the indexing tab 647 is designed to be flexible enough to yield to an applied force, such as pressure from a finger inserted through cutout areas 646, such that the indexing tab 647 allows movement of the blister pack 620 in or out of the sheath through the outlet 644. When the blister pack 620 is pulled inwardly, or pushed outwardly, of the sheath, the indexing tab 647 flexes to allow itself to be moved from a location, for example, between first and second blister rows "R1", "R2" to a location between second and third blister rows "R2", "R3" (see FIG. 11.) This allows the blister pack 620 to be moved in shuttle fashion in and out of the sheath by a predetermined distance at a time, the distance being generally equal to the pitch "P" of the blister rows.

Returning to FIG. 10, an engaging tab 649 is struck from the first shell side panel 641 and joined to the primary shell panel 642. The engaging tab 649 is disposed at a side edge of the primary shell panel 642 such that the engaging tab 649 interrupts the fold line 654 and extends from the primary shell panel 642 toward the primary base panel 673. The engaging tab 649 and the engaging slot 669 in the lid portion 612 together provide an engaging mechanism for retaining the lid portion 612 in the closed position over the shell portion 640 when the blank 610 is erected into a container.

The basic structure of the blister pack 620 is substantially the same as that of the blister pack 20. The blister pack 620 differs from the blister pack 620 in configuration only. The blister pack 620 includes blisters 621 arranged in multiple rows, e.g., five or six rows. The blisters are arranged in two columns in the FIGS. 11 and 14.

The blank 610 is erected into a container, for example, in the following manner. Referring to FIG. 10 which shows the inside surface of the blank, the glue flap 650 and the second shell side panel 643 are folded along the fold line 655 onto the primary shell panel 642. Glue is applied to the outside surface the glue flap 650 and then, the entire shell portion 640 is folded about the fold line 653 onto the base and hinge portions 611, 613. By this means, the glue flap 650 is secured to the inside surface of the base panel 673 alongside the fold line 672 such that the fold lines 672 and 656 are substantially aligned. This results in formation of a flat sheath out of the base and shell portions 611, 640. The flat sheath is then expanded to become an erected, three-dimensional sheath. The lower closure flaps 652 and 675 are folded and secured together in a face-contacting relationship, which retains the sheath in the erected form.

Glue is then applied to the inside surface of either the inner or outer lid panel 663 or 660, and the inner lid panel 663 is brought into flat face-contacting relationship with the outer lid panel 660 so that they are secured together along their respective inside surfaces. This securing process may be achieved while the lid portion 612 is folded along the fold lines 664, 665 and 666. During the securing process, the fold line 666 is positioned on the outer lid panel 660 such that the fold line 666 is disposed parallel to the fold line 664 while it is slightly spaced from the fold line 664. This allows a triangular tubular structure to be erected from the inner and outer side panels 662, 661 and that portion of the outer lid panel 660 along the fold line 664. The secured lid panels 663, 660 with an erected tubular structure 670 are best shown in FIG. 14.

Referring to FIG. 14, the tubular structure 670 is part of the erected lid portion 612 that functions as part of an engaging mechanism for retaining the erected lid portion 612 in the closed position. The tubular structure 670 cooperates with, and enhances the function of, the slot-and-tab arrangement including the engaging slot 669 and the engaging tab 649. An engaging mechanism with this type of tubular structure and slot-and-tab arrangement is described more fully in International Application No. PCTUS08059452 which is hereby incorporated by reference. It is to be understood that more than one engaging tab 649 may be positioned along the fold line 654. It is also to be understood that more than one engaging slot 669 may be positioned along the fold line 666.

Figure 11:
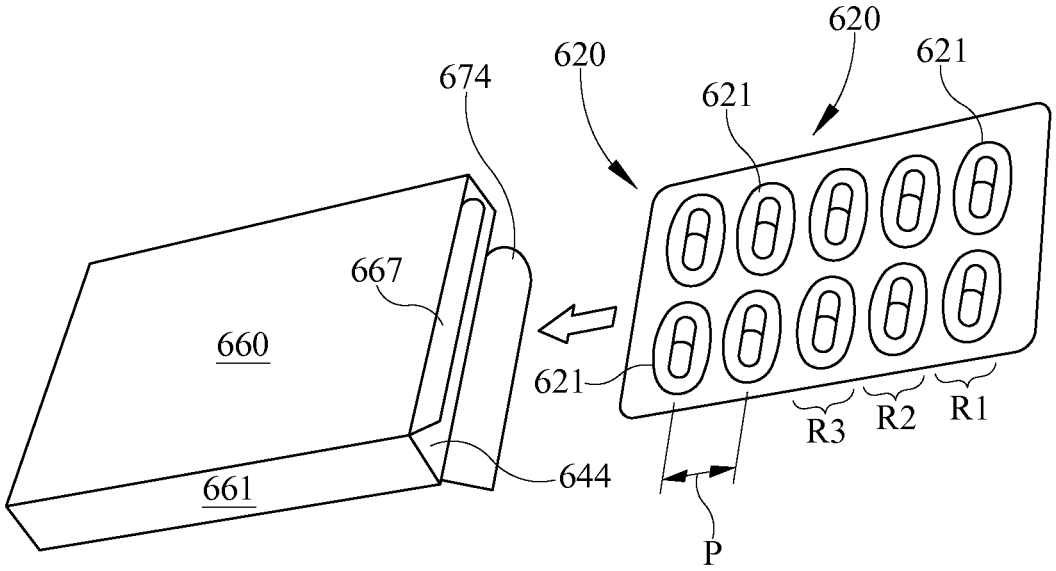

After the lid portion 612 is erected, it is brought to the closed position over the primary shell panel 642. The lid portion 612 is held in the closed position by the engaging mechanism described above. This results in a closed book-shaped container with its one end (or outlet) 644 opened as shown in FIG. 11. A product such as the blister pack 620 is loaded into the container through the outlet 644. Subsequently, the upper closure flaps 667, 674 are folded and secured together in a flat face contacting relationship. Stated differently, the arrangement with the closure flaps 667, 674 enables a product to be loaded into the container through the outlet 644. This is a significant advantage since the container may be supplied in its substantially erected form to a packaging/filling plant where a product is simply inserted into the container followed merely by closing of the end closure flaps 667, 674. Such a product loading process is compatible with existing automatic filling lines such as those used for a wide range of products housed in cartons.

Figure 12:
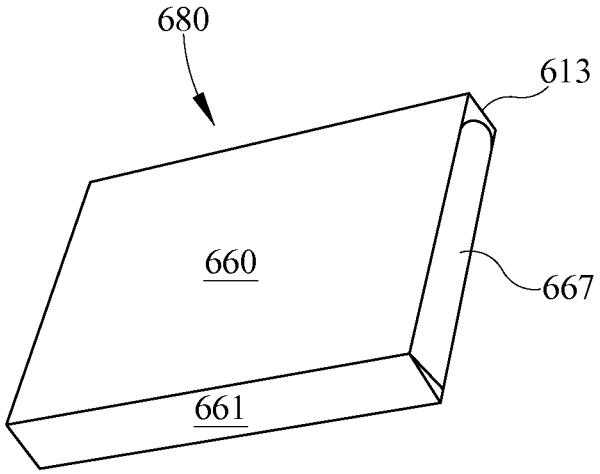

FIG. 12 shows a completely formed container 680 resulting from the above erecting process. The shell portion 640 has been attached to base portion 611 to form the sheath (FIG. 14.) The lid portion 612 and the base portion 611 are connected by the hinge portion 613, through which the lid and base portions 612, 611 may fold or hinge to a closed configuration shown in FIG. 12 in which the lid portion 612 overlies the sheath substantially in the form of a book. In the closed configuration, the slot-and-tab engaging mechanism engages in a snap fit to help the lid portion 612 in the closed position.

During manufacture of the container shown in FIG. 12, there are more than one method by which the blister pack 620 can be loaded into the container 680. The blister pack 620 may be inserted into the container in the open configuration shown in FIG. 14. Alternately, the blister pack 620 may be inserted into the container of the closed configuration shown in FIG. 12, before the closure flaps 667, 674 are folded into place.

Figure 13:
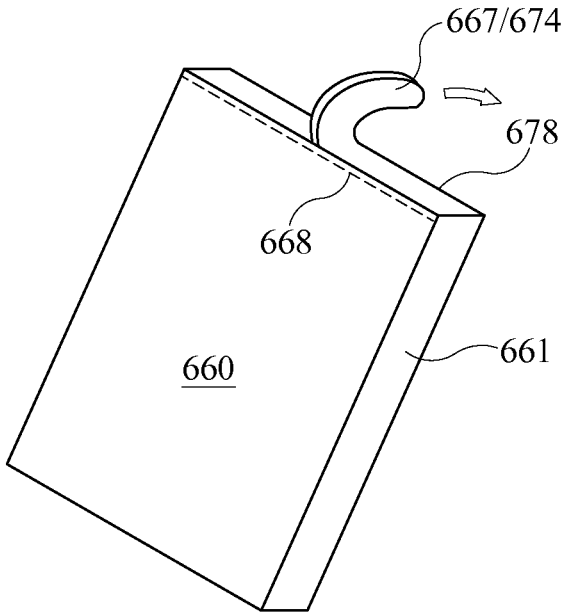

Referring to FIG. 13, the loaded container 680 may be opened by tearing the closure flaps 667/674 along the respective tear lines 668, 676 and thereby removing the closure flaps 667/674 from the container. Subsequently, the lid portion 612 is brought to the opened position by disengaging the engaging mechanism as shown in FIG. 14. The product 620 in the sheath is then pushed out of the sheath through the outlet 644 by accessing the product 620 through the cutout 646.

As described above, it is an advantage available from the arrangement with the upper end closure flaps 667, 674 that the book-shaped container can be end-loaded while in the closed configuration. However, the end closure flaps 667, 674 can also function to make the container tamper-proof because the container cannot be opened without removing the closure flaps 667, 674. The condition of the end closure flaps 667, 674 may be examined to allow consumers to see whether the container has been tampered with.

Figure 15:
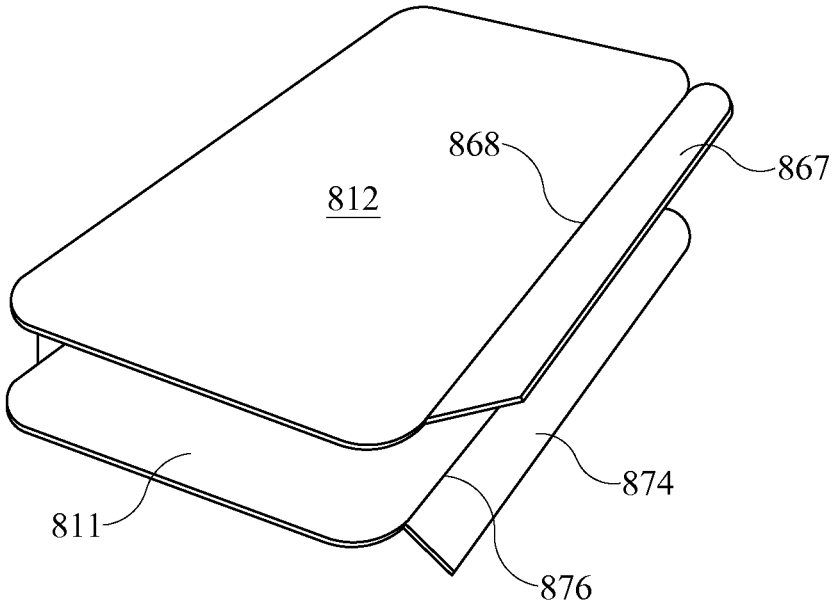
FIGS. 15 and 16 show a modified form of the container of FIGS. 1, 2A and 2B, having a pair of side closure flaps.
Figure 16:
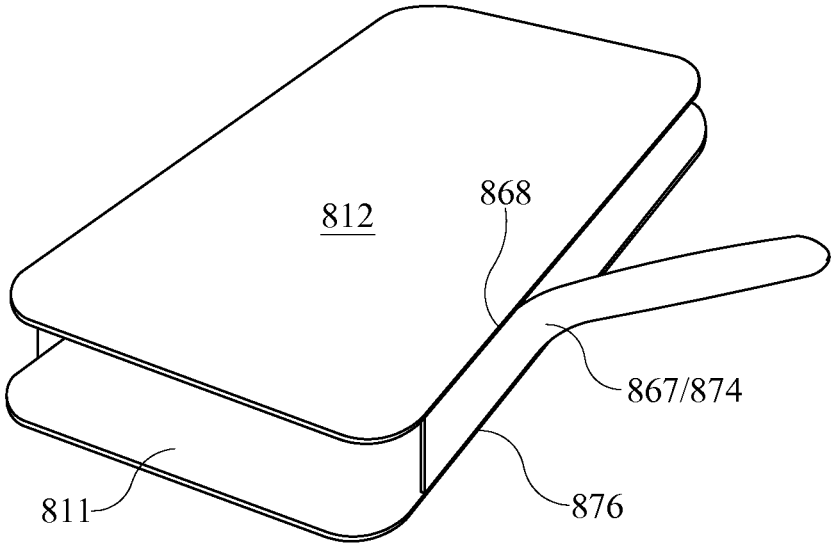

It is apparent in view of the preceding embodiments that the upper closure flaps 667, 674 may be omitted and replaced by a locking feature such as the first locking feature 220A, 240A; 320A, 340A; or 420A, 440A. The first locking feature prevents undesired exit of the loaded product through the outlet 644. Necessary modifications may be made to the containers of those preceding embodiments to enable the containers to be end-loaded while they are in the closed configuration. To add a tamper-proof capability to such modified containers, a pair of side closure flaps may be added. FIG. 15 shows an example of a container with side closure flaps in a pre-glued condition. The cover used in the example of FIG. 15 is similar to that in FIG. 1. The first side closure flap 867 is higedly connected to the cover portion 812 along a tear line 868. The second side closure flap 874 is hingedly connected to the base portion 812 along a tear line 876. The other portions of the container are omitted from FIG. 15 for the illustration purpose. The side closure flaps 867, 874 are secured together in a face contacting relationship to retain the container in a closed configuration. The secured side closure flaps 867/874 may be severed along the tear lines 868, 876 as shown in FIG. 16 and thereby be removed from the container to open it.

Figure 17:
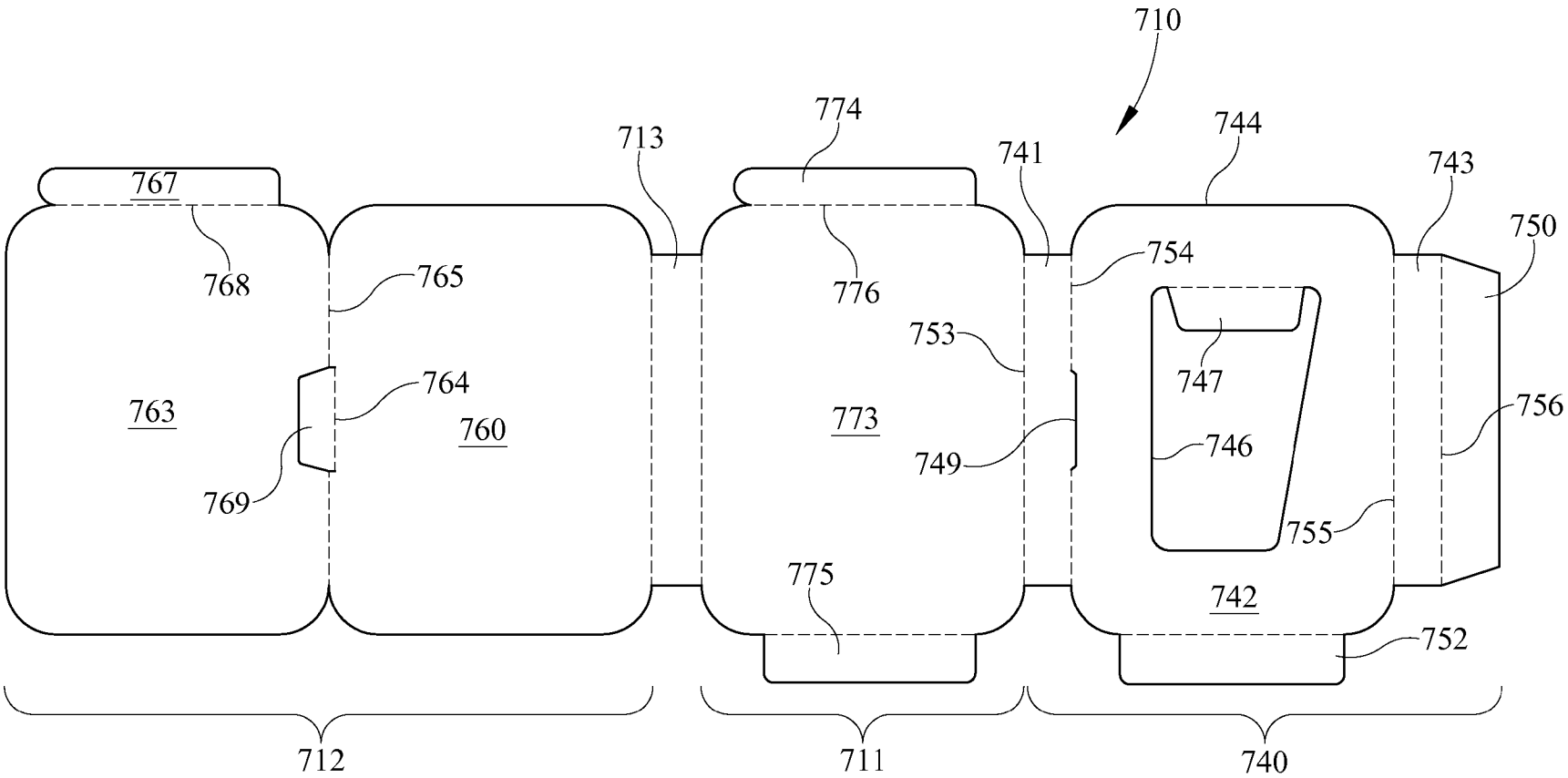
FIG. 17 is a plan view of a blank for forming an eighth embodiment of a container.

FIG. 17 illustrates an eighth embodiment of the container of the present disclosure. FIG. 17 shows a blank 710 from which the container of this embodiment is formed. The blank 710 of the eighth embodiment is substantially similar to the blank 610 of the seventh embodiment and therefore like references numerals have been used to denote like features, albeit the reference numerals in FIG. 17 have been raised by a factor '100' to indicate that they relate to the seventh embodiment. Since the eighth embodiment is similar in many respects to the arrangement illustrated in respect of the seventh embodiment, only the differences are described in detail.

The blank 710 may also be made from a foldable sheet material such as cardboard, paperboard, corrugated board, plastic, paper-plastic composite material or the like. The blank 710 comprises a base portion 711, a lid portion 712, a hinge portion 713 and a shell portion 740. The base portion 711, the hinge portion 713 and the shell portion 740 are substantially the same in structure as those of the seventh embodiment except for an engaging slit 749 and the rounded corners of each of the panels 763, 760, 773, 742. The engaging slit 749 has replaced the engaging tab 649 of the seventh embodiment to serve as part of an engaging mechanism for retaining the lid portion 712 in the closed position. The engaging slit 749 is formed substantially in the primary shell panel 742 in such a manner that the fold line 754 is interrupted by the engaging slit 749.

The shell portion 740 includes a first shell side panel 741, a primary shell panel 742, a second shell side panel 743, and a glue flap 750. The first shell side panel 741 is hingedly connected to the primary base panel 773 along a fold line 753. The primary shell panel 742 is hingedly connected to the first side panel 741 along a fold line 754. The second shell side panel 743 is hingedly connected to the primary shell panel 742 along a fold line 755. The glue flap 750 is hingedly connected to the second shell side panel 743 along a fold line 756. Attached to the lower edge of the primary shell panel 742 is a second lower closure flap 752.

The lid portion 712 differs from the lid portion 612 in that there are no side panels disposed between the inner and outer lid panels 763, 760. Furthermore, the second upper closure flap 767 is hingedly connected to the upper edge of the inner lid panel 763 along a tear line 768. Furthermore, an engaging tab 769 is struck from the inner lid panel 763 and hingedly connected to the outer lid panel 760 along a fold line 764. The fold line 764 of the engaging tab 769 is substantially collinear with the fold line 765 along which the inner and outer lid panels 763, 760 are hingedly connected. The engaging tab 769 is the other part of the engaging mechanism and is designed cooperate with the engaging slit 749 to retain the lid portion 712 in the closed position.

The primary shell panel 742 has a shell cutout area 746 for access to the interior of the sheath. Shell cutout area 746 may be large enough for a finger to be inserted therethrough to move the contents (such as a blister pack) of the sheath. The cutout area is provided with an indexing element in the form of an indexing tab 747. The indexing tab 747 serves similarly to the indexing indents 48 described in relation to FIGS. 1, 2A and 2B in that it resiliently engages the blisters of a blister pack as they pass the indexing tab 747 so as to provide an indexing function whereby the blister pack is releasably held in a plurality of dispensing positions as it is withdrawn from the sheath.

The blank 710 may be erected into a container, for example, in the substantially the same way in which the blank 610 is erected except that the lid portion 712 may be erected much more simply. Glue is applied to the inside surface of either the inner or outer lid panel 763 or 760, and the inner lid panel 763 is folded about the fold line 765 onto the inside surface the outer lid panel 760. There is no triangular tubular structure that is formed during the folding process of the lid panels.

The secured lid portion 712 is brought to the closed position over the primary shell panel 742 of an erected shell portion 740. The lid portion 712 is locked in the closed position by the slit-and-tab engaging mechanism described above. To activate the engaging mechanism, the engaging tab 769 is inserted into the slit 749 so that it is retained in the slit by friction. The resultant container looks similar to the one shown in FIG. 11. A product such as the blister pack 620 is loaded into such a container through the outlet 744. The upper closure flaps 767, 774 are then folded and secured together in a flat face contacting relationship. The loaded container may be opened by tearing the secured closure flaps 767/774 along the tear lines 768, 776. The product in the sheath is then pushed out of the sheath through the outlet 744 by accessing the product through the cutout 746.

Other embodiments of a container for housing a tray or blister pack are disclosed in GB0804831.6 and GB0808506.0, the disclosures of which are hereby incorporated herein. Features of these other embodiments may also be used in combination with features of the embodiments illustrated and described in the present application.

For the packages disclosed herein, it may be advantageous for the sheath formed by the shell and base to fit closely or snugly to the contours of articles or items within the shell. For example, if cigarettes are held within the shell, the shell may be moulded or otherwise formed to closely match the contour of the cigarettes. At least a portion of the shell may be shaped with channels to closely hold the cigarettes. For example such channels or contours may be useful for guiding individual cigarettes out of the shell without taking a skewed position that could interfere with easy movement, or damage the cigarettes. The channels also prevent articles from sliding sideways when the package is partially empty. A channel may be provided for each cigarette, or for pairs or small multiples of cigarettes. The shell may comprise at its outlet an indexing feature such as an indent, depression, bump, or other feature to prevent the cigarettes from sliding out of the package until the user pushes them out. The shell cutout area may extend to the end wall of the package in order to facilitate pushing on the end of the cigarettes to slide them from the package. The shell cutout area may also extend onto one or both side walls (not shown). The cutout area may comprise more than one opening.

From the preceding descriptions, it can be seen that the shell provides a sheath which is a very close fit to various contents of a package. For example, the close fit may be a contoured fit along a portion of the length of an item, such as a cigarette; a narrow gap to accommodate sliding movement of a planar portion such as the edge portion of a blister pack; or a snug fit to certain features of the contents, such as the tops or sides of blisters on a blister pack. The (or each) shell is preferably shaped to house a single layer of the article to be contained, i.e., a single blister pack or a single layer of cigarettes (rather than a double layer as provided for in many conventional containers).

In these packages, the shell cutout areas may be used to push articles slidably out of the shell, or draw them into the shell. The cutout areas may also be used to push downward upon articles to flex the articles and thereby help them to clear or disengage from indents or other stops or indexing features, in order to more freely move out of the package. The shell cutout areas, in certain packages, may provide a viewing access for information printed inside the shell. While the shell cutout area may usually be on a major face of the shell, it may in some packages extend into an end wall or side wall of the shell. For example, a shell cutout area extending into an end wall of the shell may be useful for access to items such as cigarettes.

In these packages, the lid portion may cover the shell cutout area when the package is in the closed configuration. Preferably the contents of the package are not visible in the closed configuration. If the shell cutout area extends onto an end wall or side wall of the shell, then the lid may have flanges or projections to occlude these portions of the shell cutout area.

The above containers may be formed by folding a sheet material or materials. Certain parts of the above containers, for example the shell and frame portions, may be formed by processing such as thermoforming, vacuum forming, pressure forming, etc as is known to those skilled in the art. Certain parts may be formed by injection moulding. In certain embodiments, the moulded parts of the container may be made of materials chosen for heat sealing to the base and lid portions of the container, which may be coated with materials suitable for heat sealing. Alternately, other means such as adhesives may be used for attaching the moulded parts to the base and lid.

Certain embodiments of the shell as shown herein use a "stepped" structure (e.g. formed in part by a first recess and a second recess), a structure that may be readily formed, for example, by thermoforming of plastic. However, alternative structures, having different numbers of steps, or having sloped sides with or without steps, are also within the scope of the disclosure. A pressed or folded paperboard shell, for example, may have sufficient strength and be more readily formed with sloping sides rather than stepped sides.

Being able to load a tray or blister pack into the container through an open end of the container as described above is a significant advantage as such an arrangement is compatible with existing automatic filling lines such as those used for a wide range of products housed in cartons.

By forming only the shell (and optionally, a frame) of the container of plastic so that the major faces thereof are provided by the outer cover, the amount of plastic material used can be minimised. The outer cover can be securely bonded to the framework so that the security of the container is not compromised. Such an outer cover may also have information or graphics provided thereon and both faces thereof may be visible.

Certain of the embodiments described above has an indexing feature for locating a tray or blister pack in a container and is adapted to enable sliding of the tray or blister pack within the container. The embodiments illustrate several mechanisms for achieving this, while (in the case of blister packs for example) using blister packs not requiring any special features other than the blisters themselves.

The embodiments of the containers described here are all designed to facilitate single-handed operation. The user may for example, using one hand, open the container, slide a blister pack at least partly out of the shell, and press a blister to open the blister and dispense its contents.

Graphics may be provided on the external surfaces of the container, for example, the external surfaces of base 11 and lid 12 (see FIGS. 1 and 2B.) Graphics may also be provided on the internal surface of the lid 12, which are visible through the frame cutout area 66 (or, for lid 212, visible since there is no frame). Graphics may also be provided on the internal surface of base 11, which are gradually revealed as the blister pack is slid out. Typically, such graphics would indicate time intervals appropriate to the medication housed in the tray or blister pack, e.g. the days of the week and/or the time of day (morning, afternoon, evening, night). Graphics may also be provided on a leaflet or booklet housed in the container. Preferably the leaflet (which may comprise several pages connected in concertina fashion) or booklet is attached o the container, e.g. by having one page thereof glued to a face of the container.

As described above, in the first embodiment even it its "closed" configuration (with the closure flap 14 open or in a version without such a flap) provides an aperture through which a tray or blister pack (and, optionally, compliance literature) can be inserted into the container. The ability to load a tray or blister pack into a container in this manner provides significant advantages, as the container can then be filled in a conventional filling line, e.g. as used to load trays or blister packs into conventional cardboard cartons or plastic sheaths.

Thus, it will be appreciated that, in the preferred embodiments, the tray or blister pack can be both slid into the container and slid out of the container as articles are dispensed.

Some of the embodiments described are able to house a standard blister pack which requires no modification. These embodiments are particularly suited to blister packs used in 'over the counter sales' e.g. for medicines etc which do not require a prescription. Other embodiments, particularly those having child resistant features, may require blister packs having additional features. These are more suited for higher value articles and/or articles whose availability is more closely regulated, e.g. medicines which require a doctor's prescription.

Each of the embodiments described comprises a lid portion and base portion which, in the open configuration, lie substantially flat and, in the closed configuration, the lid portion overlies the base portion substantially in the form of a book (as distinct from a carton which has a small flap or lid for closing an opening at one end of the carton).

In each of the embodiments, part of the lid and/or the hinge portion covers the open end of the sheath in the closed configuration. Preferably, in the closed configuration, all apertures or openings in the sheath are covered in the closed configuration so the articles housed in the container are concealed. However, in some cases, a cutout, particularly if provided in the base portion rather than in the shell, need not be covered if it only reveals a small portion of the underside of the article, e.g. the foil layer of a blister pack or the underside of a tray, rather than the contents of the tray or blister pack. Preferably, a single opening action, e.g. movement of the lid portion from the closed to the open position, is required to open the container so that the articles can then be slid out.

Each of the embodiments provides a container in which the article(s) housed therein can be slid out, or dispensed therefrom, in a controlled manner. The shell preferably contacts the article on all sides thereof and so provides a guide channel along which it can be slid in a linear and controlled manner. Preferably one or more features are provided to inhibit the article(s) from sliding out accidentally and/or indexing the sliding movement in steps.

The embodiments described above provide a wide variety of features. Many of these features can be inter-changed between embodiments. Further embodiments are thus envisaged which use a selection of the features from those described above. The present disclosure thus extends to cover containers having other combinations of the features described.

As used in this disclosure, directional references such as "top", "base", "bottom", "end", "side", "inner", "outer", "upper", "middle", "lower", "front", "rear" and "back" do not limit the respective panels, flaps or otherwise portions of the container to such orientation, but merely serve to distinguish these portions from one another. Furthermore, the various embodiments demonstrate that the panels, flaps and portions may be hingedly connected to one another. Any reference to a hinged connection should not be construed as necessarily referring to a junction including a single hinge only; indeed, it is envisaged that a hinged connection can be formed from one or more potentially disparate means for hingedly connecting materials. The term "fold line" as used in this disclosure refers to a score line, a perforation, a line of short slits/cuts, a line of half-cuts, a printed line, any combination thereof or the like. The term "tear line" as used in this disclosure refers to a perforation, a line of short slits/cuts, a line of half-cuts, a single half-cut, any combination thereof or the like.

The invention claimed is:

1. A container for housing one or more articles, the container comprising a base portion, a shell attached to the base portion to form a sheath for receiving one or more articles, and a lid portion hingedly connected to the sheath such that the lid portion and/or base portion are movable between an open configuration and a closed configuration in which the lid portion overlies the shell, the sheath having an outlet through which one or more articles are allowed to slide relative to the sheath in a direction substantially parallel to the base portion between a storage position and one or more dispensing positions, wherein the shell comprises a primary shell panel and a shell side panel, the shell side panel being connected to the primary shell panel by a first fold line, the shell primary panel having a cutout area adapted to allow a finger or object to be inserted therethrough to slidably move one or more articles at least partly out of or into the sheath, the shell comprising an indexing tab for yieldably restricting movement of one or more articles, the indexing tab being hingedly connected to the primary shell panel along a perimeter of the cutout area and being folded inwardly of the sheath to interfere with movement of one or more articles in the sheath.

2. A container as claimed in claim 1, further comprising a closure for closing the outlet of the shell, the closure comprising at least one closure flap hingedly connected to at least one of the lid and the base portion.

3. A container as claimed in claim 1, wherein the perimeter of the cutout area includes first and second opposed end edges, the first end edge being proximate one end of the sheath where the outlet is located, the second end edge being proximate the other end of the sheath opposite the outlet, and wherein the indexing tab is hingedly connected to the first end edge by a second fold line.

4. A container as claimed in claim 3, further comprises one or more articles removably received in the sheath, wherein the direction of movement of the one or more articles is substantially perpendicular to the second fold line.

5. A container as claimed in claim 4, wherein the indexing tab is connected to the shell such that the indexing tab enables sliding of the one or more articles relative to the indexing tab in a direction substantially parallel to the base portion between the storage position and the at least one dispensing position, the indexing tab extending into the sheath to provide an interference fit with the one or more articles.

6. A container as claimed in claim 5, wherein the indexing tab is disposed to resiliently engage the one or more articles as the one or more articles pass the indexing tab so that the one or more articles are releasably held in a plurality of dispensing positions as the one or more articles are withdrawn from the sheath.

7. A container as claimed in claim 6, wherein the one or more articles comprises a blister pack having at least two rows of blisters, and the indexing tab is disposed between adjacent ones of the at least two rows of blisters to interfere with movement of the blister pack.

8. A container as claimed in claim 3, wherein the second fold line is disposed substantially perpendicular to the first fold line by which the shell side panel is connected to the primary shell panel.

9. A container as claimed in claim 8, wherein the shell side panel is connected to the base portion by a third fold line which is substantially parallel to the first fold line.

10. A container as claimed in claim 3, wherein the other end of the sheath is closed by a closure, the closure comprising at least one closure flap hingedly connected to at least one of the primary shell panel and the base portion.

11. A container as claimed in claim 1, wherein the cutout area is shaped and dimensioned such that one or more articles in the sheath are visible from the outside of the sheath through the cutout area.

12. A combination comprising a container and one or more articles housed in the container, the container comprising a base portion, a shell attached to the base portion to form a sheath for receiving the one or more articles, and a lid portion hingedly connected to the sheath such that the lid portion and/or base portion are movable between an open configuration and a closed configuration in which the lid portion overlies the shell, the sheath having a cutout area through which a finger or object may be inserted to slidably move the one or more articles relative to the shell in a direction substantially parallel to the base portion between a storage position and one or more dispensing positions, the cutout area being covered by part of the lid portion when the container is in the closed configuration, the cutout area being shaped and dimensioned such that the one or more articles in the sheath are visible from the outside of the sheath through the cutout area, wherein the shell comprises a restricting feature for yieldably restricting movement of the one or more articles, wherein the sheath has an outlet at one end thereof through which the one or more articles are allowed to slide relative to the sheath in a direction substantially parallel to the base portion between a storage position and one or more dispensing positions, and wherein the shell comprises a primary shell panel and a shell side panel, the shell side panel being connected to the primary shell panel by a first fold line.

13. A combination as claimed in claim 12, wherein the restricting feature comprises at least one indexing element for locating the one or more articles within the sheath such that the at least one indexing element enables sliding of the one or more articles relative thereto in the direction substantially parallel to the base portion between the storage position and the one or more dispensing positions, the at least one indexing element extending into the sheath to provide an interference fit with the one or more articles.

14. A combination as claimed in claim 13, wherein the at least one indexing element is disposed to resiliently engage the one or more articles as the one or more articles pass the at least one indexing element so that the one or more articles are releasably held in a plurality of dispensing positions as the one or more articles are withdrawn from the sheath.

15. A combination as claimed in claim 14, wherein the at least one indexing element comprises at least one indexing tab connected to an edge of the cutout area.

16. A combination as claimed in claim 15, wherein the at least one indexing tab extends from the shell into the sheath.

17. A combination as claimed in claim 15, wherein the one or more articles comprises a blister pack having at least two rows of blisters, the at least one indexing tab is disposed between adjacent ones of the at least two rows of blisters to interfere with movement of the blister pack.

18. A combination as claimed in claim 12, wherein the cutout area has first and second opposed end edges, the first end edge being proximate the outlet, the second end edge being proximate the other end of the sheath opposite the outlet, the restricting feature comprising an indexing tab hingedly connected to the primary shell panel along the first end edge of the cutout area, the indexing tab being folded inwardly of the sheath to interfere with movement of the one or more articles.

* * * * *